US010364566B1

(12) United States Patent
LeBlang

(10) Patent No.: US 10,364,566 B1
(45) Date of Patent: Jul. 30, 2019

(54) SELF-LOCKING METAL FRAMING CONNECTIONS USING PUNCHED OUT TABS, LEDGES AND NOTCHES

(71) Applicant: Dennis LeBlang, Palm Desert, CA (US)

(72) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 15/295,172

(22) Filed: Oct. 17, 2016

(51) Int. Cl.
*E04B 1/38* (2006.01)
*E04B 1/41* (2006.01)
*E04B 2/58* (2006.01)

(52) U.S. Cl.
CPC ..... *E04B 1/40* (2013.01); *E04B 2/58* (2013.01); *E04B 2001/405* (2013.01)

(58) Field of Classification Search
CPC ..... E04B 1/40; E04B 2/58; E04B 2001/405; E04B 1/7608; E04B 1/7654; E04C 3/07
USPC ... 52/712, 715, 243, 317, 349, 481.1, 655.1, 52/696, 653.1, 654.1, 667, 656.9, 713, 52/714, 703, 710, 711
See application file for complete search history.

(56) References Cited

U.S. PATENT DOCUMENTS 1,165,049 A 12/1915 White
3,780,209 A * 12/1973 Schuplin ..... H02G 3/125 174/51
3,845,601 A 11/1974 Kostecky
3,952,462 A 4/1976 Heise
3,962,840 A 6/1976 Nelsson
4,793,113 A 12/1988 Bodner
4,805,364 A 2/1989 Smolik
4,809,476 A 7/1989 Satchell
5,058,352 A 10/1991 Loiselle
5,127,760 A 7/1992 Brady
5,157,883 A 10/1992 Meyer
5,189,857 A 3/1993 Herron
5,207,045 A 5/1993 Bodnar
5,274,973 A 1/1994 Liang
5,321,924 A 6/1994 Smolik
5,325,651 A 7/1994 Meyer
5,394,665 A 3/1995 Johnson
5,581,953 A 12/1996 Rutt
5,596,859 A 1/1997 Horton
5,720,138 A 2/1998 Johnson
5,749,192 A 5/1998 Menchetti
5,797,233 A 8/1998 Hascall
5,884,448 A 3/1999 Pellock
(Continued)

OTHER PUBLICATIONS

Simpson Strong—Tie Company Inc., Pleasant, CA Title of Catalog: BBR & DBR Spacer Bracers, dated Jan. 1, 2017.

*Primary Examiner* — William V Gilbert

(57) ABSTRACT

The present invention relates to metal framed wall components with self-locking connections having ledges connected to support members and crossing connecting members having punch out tabs being connected to ledges, notches and tabs being connected to other tabs interlocking together to connect wall components together. The wall components spanning between support members connected by holes from support members, hooked receivers, hooked tongues, hook finger ends from the wall components wherein also U-shaped and W-shape clips can also connect other wall components. The wall components can be installed individually or in tandem vertically, horizontally and diagonally between support members or over the side edges.

4 Claims, 30 Drawing Sheets

(56) References Cited

U.S. PATENT DOCUMENTS

| | | | |
|---|---|---|---|
| 5,899,042 | A | 5/1999 | Pellock |
| 5,943,838 | A | 8/1999 | Madsen |
| 5,956,916 | A | 9/1999 | Liss |
| 6,164,028 | A | 12/2000 | Hughes |
| 6,199,336 | B1 | 3/2001 | Poliquin |
| 6,260,318 | B1 | 7/2001 | Herren |
| 6,301,854 | B1 | 10/2001 | Daudet |
| 6,374,558 | B1 | 4/2002 | Surowiecki |
| 6,397,550 | B1 | 6/2002 | Walker |
| 6,401,423 | B1 | 6/2002 | Bergeron |
| 6,557,254 | B1 | 5/2003 | Johnson |
| 6,578,335 | B2 | 6/2003 | Poliquin |
| 6,647,691 | B2 | 11/2003 | Becker |
| 6,694,695 | B2 | 2/2004 | Collins |
| 6,701,689 | B2 | 3/2004 | diGirolamo |
| 6,739,562 | B2 | 5/2004 | Rice |
| 6,748,705 | B2 | 6/2004 | Orszulak |
| 6,761,005 | B1 | 7/2004 | Daudet |
| 6,792,733 | B2 | 9/2004 | Wheeler |
| 6,843,035 | B1 | 1/2005 | Glynn |
| 6,854,237 | B2 | 2/2005 | Surowiecki |
| 6,983,569 | B1 | 1/2006 | Rosenberg |
| 7,073,757 | B2 | 7/2006 | Johnson |
| 7,159,365 | B2 | 1/2007 | Colen |
| 7,216,465 | B2 | 5/2007 | Saldana |
| 7,240,459 | B2 | 7/2007 | Daudet |
| 7,360,745 | B2 | 4/2008 | Nikayin |
| 7,596,921 | B1 | 10/2009 | diGirolamo |
| 7,640,701 | B2 | 1/2010 | Rutherford |
| 7,743,578 | B2 | 6/2010 | Edmondson |
| 7,770,348 | B2 | 8/2010 | Tollenaar |
| 7,779,593 | B2 | 8/2010 | Jahn et al. |
| 7,823,350 | B2 | 11/2010 | Valle |
| 7,836,657 | B1 | 11/2010 | diGirolamo |
| 7,866,112 | B2 | 1/2011 | Edmondson |
| 7,975,448 | B2 | 7/2011 | Jahn |
| 8,011,160 | B2 | 9/2011 | Rice |
| 8,079,561 | B2 | 12/2011 | Jafari |
| 8,333,049 | B2 | 2/2012 | Badger |
| 8,205,402 | B1 | 6/2012 | diGirolamo |
| 8,245,466 | B2 | 8/2012 | Wright |
| 8,262,043 | B2 | 9/2012 | Jafari |
| 8,281,540 | B2 | 10/2012 | Strickland |
| 8,424,266 | B2 | 4/2013 | Edmondson |
| 8,615,959 | B2 | 12/2013 | Ferguson |
| 8,733,044 | B2 | 5/2014 | Dollerup |
| 9,127,456 | B2 | 9/2015 | Dollerup |

* cited by examiner

SELF-LOCKING METAL FRAMING CONNECTIONS USING PUNCHED OUT TABS, LEDGES AND NOTCHES

CROSS REFERENCED TO RELATED APPLICATION

This application claims priority from U.S. provisional application No. 62/242,705, filed Nov. 15, 2015 which is part of U.S. patent application Ser. No. 15/090,460 and U.S. provisional applications 62/244,135 filed Nov. 20, 2015 and U.S. provisional application 62/264,033 filed Dec. 7, 2015 and U.S. provisional application 62/274,134 filed Dec. 15, 2015 and U.S. provisional application 62/345,153 dated Jun. 3, 2016 by the inventor hereof the entire disclose of which is incorporated herein by reference. The disclosures of the above cited US Patent Applications and US Provisional Applications of the Applicant, including all drawings and all the specifications, are hereby in incorporated by reference in their entireties into this US Patent Application.

FEDERALLY SPONSORED RESEARCH OR DEVELOPMENT

Not applicable

PARTIES OR JOINT RESEARCH

Not applicable

FIELD OF THE INVENTION

The present invention relates to forming self-locking connections between intersecting metal framing members having ledges at the top and bottom edges of the web or at any of the side edges of the holes in the web of the support members and where a crossing member has hooked fingers, hooked receivers or tabs from the punch out holes wrap-around the ledges that extend outward from the web of the support members. The wrap-around elements of the connection extend around the ledge and then continuous extending outward from the support member forming a flare shape. The flare shape allows the ledge to be inserted into the wrap-around elements by allowing the wrap-around to be slightly for the ledge to fit into. When the ledge is inserted into a crossing member at the top or bottom of the support member, the flanges have to be cut and notched in the flanges allowing the ledges to interlock into the notches of the spacer braces or crossing members. The ledge can be deep or as little as the thickness of a thread of a screw. The ledge can be a continuous length equal or greater than the width of a spacer brace or can be small so the ledge is an array of ledge teeth that can penetrate a ledge hole and still form a self-locking connection. The self-locking connection is formed when the wrap-around elements are wrapped around the ledge. The hooked receiver, hooked finger, W-shape & U-shape clips also form the wrap-around elements that secure the ledge.

BACKGROUND OF THE INVENTION

Light gauge metal framing have been used in the construction of buildings for many years, however interior and exterior metal framing has always been difficult to assemble as well as construct horizontal and diagonal bracing between support framing members because of the configuration of the support members like a C channel and poor energy efficient shear wall construction. The lip and flange of the C channel protrudes from the web making it difficult to make connections. When bracing members are installed between support members for additional strength, insulation became even more difficult to install as well as form a better insulated wall.

When assembling metal framed walls the vertical support members are not rigid until the bracing members or fasteners are added to help stabilize the support members from moving. In the past there have been attempts to stiffen support members by providing lateral bracing, drywall backing or bracing members between vertical support members.

The bracing members within the wall forming structure are generally required to connect support members together, however horizontal bracing members can be very long and next to impossible to connect horizontal bracing members to individual spacer blocks located between support members. In addition the bracing members are not used to form shear walls or diagonal framing with the walls or have the flexibility to form trusses having diagonally framing members.

Metal framing has developed computer systems to form pre-punched screw holes to designate how and where to install fasteners between metal framing. Different types of notches or shapes of bracing members have help speed up framing assembly. There have been no innovation developed allow metal framing to be connected without using fasteners and nothing has been developed where the spacer brace connects support members together using W clips, U clips, punch-out tables and ledges that form a self-lock connectors that fit together to form a fast an easy connection means to form metal framed wall panels without using fasteners at the support members. The unique wall construction allows wall panels to be fabricated quickly and easily without using fasteners thereby saving money in labor and material.

DESCRIPTION OF PRIOR ART

The horizontal and diagonal connections between metal support members do not form continuous bracing that interlocks between each other but rather are individual components. Individual mounting brackets are used to support trusses or horizontally brace support members. Many different shapes of horizontal bracing members are used to connect metal framing members together and include various grooves, tabs, bridging backing, notches to connect the metal framing members together. Some types of connections between support members use bent hooks, bent flanges, clamping tabs, anchoring hand rail system, adjustable braces or extended tabs to connect trusses. Existing bracing members do not connect support members together at corners, provide drywall backing and connect wall panels together. Different types of brackets, shapes, leg supporting connections and blocking are used to install support members together. Slotted holes at the top base plate have been used to compensate for vertical movement between vertical and horizontal support member. Spacer braces do use various types of clips with fasteners to interlock between support members to prevent vertical and horizontal movement. There is no prior art for U or W shaped clips with spacer braces to secure support members together. Some support members have been shown to have a rim around the hole for extra strength or to reduce thermal conductivity through the support member, but not used a part of a self-locking connector. Punch out tabs has been used as spacers or as tabs where the tabs have been used to support another object.

SUMMARY OF THE INVENTION

The present invention are the means used to form interlocking metal framing members together without typically requiring fasteners to connect two intersecting framing members together. The building components connect different building construction components together to form integrated building wall and floor assemblies using the light gauge metal framing members. The framing members can be short spacer braces that connect vertical or horizontal support members together individually, diagonally and or in tandem between adjacent spacer braces or can be continuous where the framing member passes through or under a support member. The spacer braces can have a variety of shapes that is U-shape, C-shape, J-shape or I-shape and can be connected to the support members in many different ways. The spacer braces can have an end shape of a hook finger, hook tongue or a hook receiver and can be connected to a U-shaped clip or W-shaped clip which can also be connected to the support member. The spacer braces and the support members are shown in this application how the spacer braces interlock to the support members using punch out tabs, wrap around tabs, notches and ledges.

The spacer braces can be individual horizontal bracing members that pass through the holes of support members, under or over the ends of the support members to secure the support members together. When the spacer braces passes through the holes in the support members, the horizontal movement is eliminated the side edges of the holes in the direction of the web and notches or the flanges and hook fingers of the spacer brace eliminate the horizontal movement along the flanges of the support member. The spacer braces can fit into the hole of the support member, over or under the web of the support member or over the flange of the support member. The spacer braces can have the web oriented vertically or horizontally. The spacer braces can be installed at a diagonal whether the web is oriented vertically or horizontally. The spacer braces can be installed individually between support members, or as an elongated spacer braces spanning between several support members or be in tandem using the end or ends of the spacer bracer as the hook receiver. The U or W shaped clips can also be oriented vertically, horizontally, through the hole, over the flange, over the web, under the web, connected to the ledge or not connecting the ledge of the support member. A spacer brace can be connected to the support member in tandem or as individual spacer braces so that six different spacer braces can interested adjacent to one another allow the structural capacity of the spacer braces to transfer their load capacity the same way horizontal and diagonal structural members of a bridge span together to form one unified structure.

Spacer braces can also be used as base plates at the floor or ceiling joists where the tongue and receiver sides fit together to form a continuous base place and can vary how the tongue and receiver sides interconnect to each other.

Support members are spaced at standard distances between each other and the spacer braces are designed to connect to the support members webs and the standard intervals, however additional support members are added between the standard spacing and bunched together to form a stronger support member. Different Add-on spacer brackets are shown having the same U-shape as other spacer braces in order to have all the spacer braces interlock with each other. In addition, W and U shaped clips are shown as having hook receiver on one or both ends for the hook tongue of the spacer braces can fit into. The clips can be used in place of the U-shaped hook receiver of the spacer brace. The clips can fit vertically or horizontally: into the holes of the support members; over or under the web of the support members; over the flanges of support members being wood or metal or individual or multiple spacer brace connections; between adjacent webs of support members; into triangle shape holes and still have two spacer braces connect to the clip.

When the spacer braces are installed in the holes between rafters or ceiling and floor joists, the spacer braces might be installed so the webs are in a vertical position that way the flanges of the spacer braces can be installed into the middle of the wall where the flanges of the spacer brace have the least resistance. Depending on the function of the spacer block, additional spacer braces can be installed either diagonally as cross-bridging or horizontally as additional support for the spacer block when the spacer braces have the web oriented either horizontally or vertically.

When the spacer braces and the U-shaped clip and W-shaped clip are designed to have punch-out tabs where the tabs are punched out to engage the side of the support member, the top or bottom of a ledge that extends perpendicular to the support member or engage the sides of the ends of the hook finger, hook tongue; hook receiver, U-shaped clip or W-shaped clip to engage each other to make a secure connections between the framing elements. The ledge forms a vertical shelf that holds the spacer brace and clips from moving in a vertical and horizontal dimension depending on their orientation to the support members. The tabs can have a hook shape where the tab passes through a slot hole to interlock the tab to the support member. The ledge gap space formed by the ledge when the ledge is bent perpendicular to the support member, allows the extensions, the W or C shaped clips or the spacer brace side edges engage the side edges of the ledge gap to eliminate any side movement to form a self-locking connector without using fasteners. When the tab from web of a spacer brace has the punch-out tabs extend under or over the ledge the spacer brace is locked into position. Many different interlocking connections with the tabs are shown thereby eliminating the need for fasteners to secure these connections.

The description of the drawings and the description via the claims sound different, but are the same. At the end of the figure description is a figure table of contents noting the embodiments to a number. After that figure table of contents is a claim glossary of terms relating to the figure numbers. Since the spacer brace can be used in so many different configurations and orientations, but are installed the same, the interlocking connections need to be claimed in a different manner.

BRIEF DESCRIPTION OF THE DRAWINGS

FIG. 27 174 shows a plan view of FIG. 25.

DESCRIPTION OF THE PREFERRED EMBODIMENTS

The drawings show various types of connections using interlocking spacer braces, bracing clips, hook clips and bracing brackets that connect different building construction components together to form integrated building wall and floor assemblies using the light gauge metal framing. The spacer braces connect vertical or horizontal support members together individually, diagonally and or in tandem between adjacent spacer braces. The bracing clips, bracing brackets can be installed vertically or horizontally so the spacer braces can connect to them to also form diagonal spacer braces giving the flexibility to form a framing structure using wood or metal framing support members. Interlocking Thermal Insulating Blocks referred to as spacer blocks fit between the support members using the support members and spacer braces and their brackets and clips to secure the spacer blocks to the support members.

Figure 1:
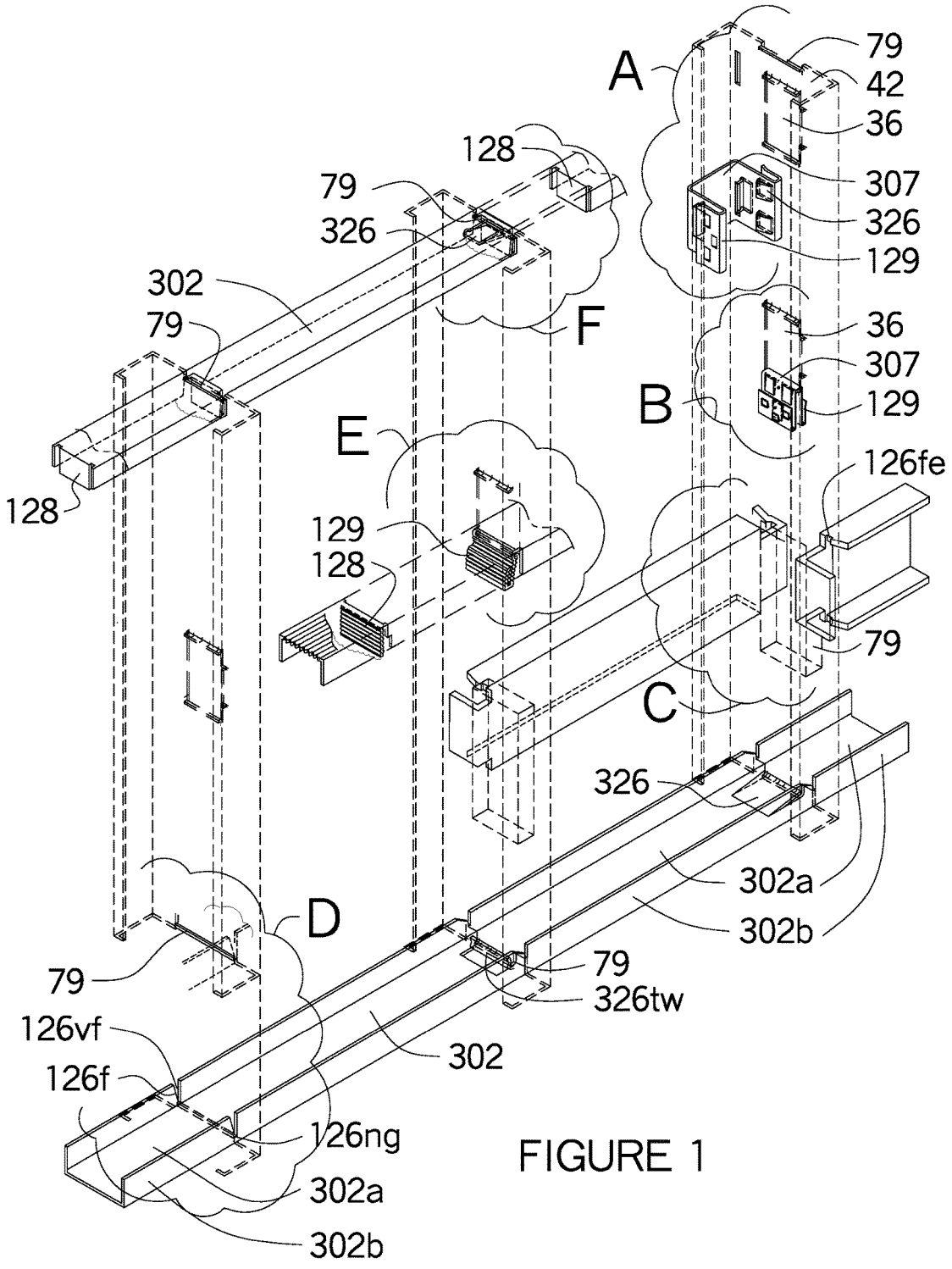
FIG. 1 is an elevation showing the nine clouds formations where each cloud represents a different configuration means for securing crossing members together by using either ledges, notches and punch-out tabs between the support members to form different self-locking framing connections between metal framed wall components for a building.

FIG. 1 shows an isometric view crisscrossing metal framing members highlighting various figures described within the cloud formations. Many different configurations or variations are shown throughout this application, for example Cloud A shows a hole 36 with ledges shown in FIGS. 2 & 37 along with a W-shaped clip 307 shown in FIGS. 15-17, 40 & 49 plus in Cloud B. Cloud B shows the W-shaped clip 307 installed in the hole 36 shown in FIGS. 3-13 as well as other figures having various configurations. Cloud C shows the U shaped spacer braces 302 installed vertically at the hole 36 as described in FIGS. 42-43. Cloud D shows three different configurations of how the ledge 79 is installed in vertical-flange notches 126*vf* or wrap-around tab 326*tw* or a tab 326*t* from a punched out tab 326 more fully described in about 10 figures. Clouds E & F show the hook tongue 128 installed within the hook receiver 129 along with punched out tabs 326 or ledges 79 with flange-edge notches 126*fe*.

Figure 2:
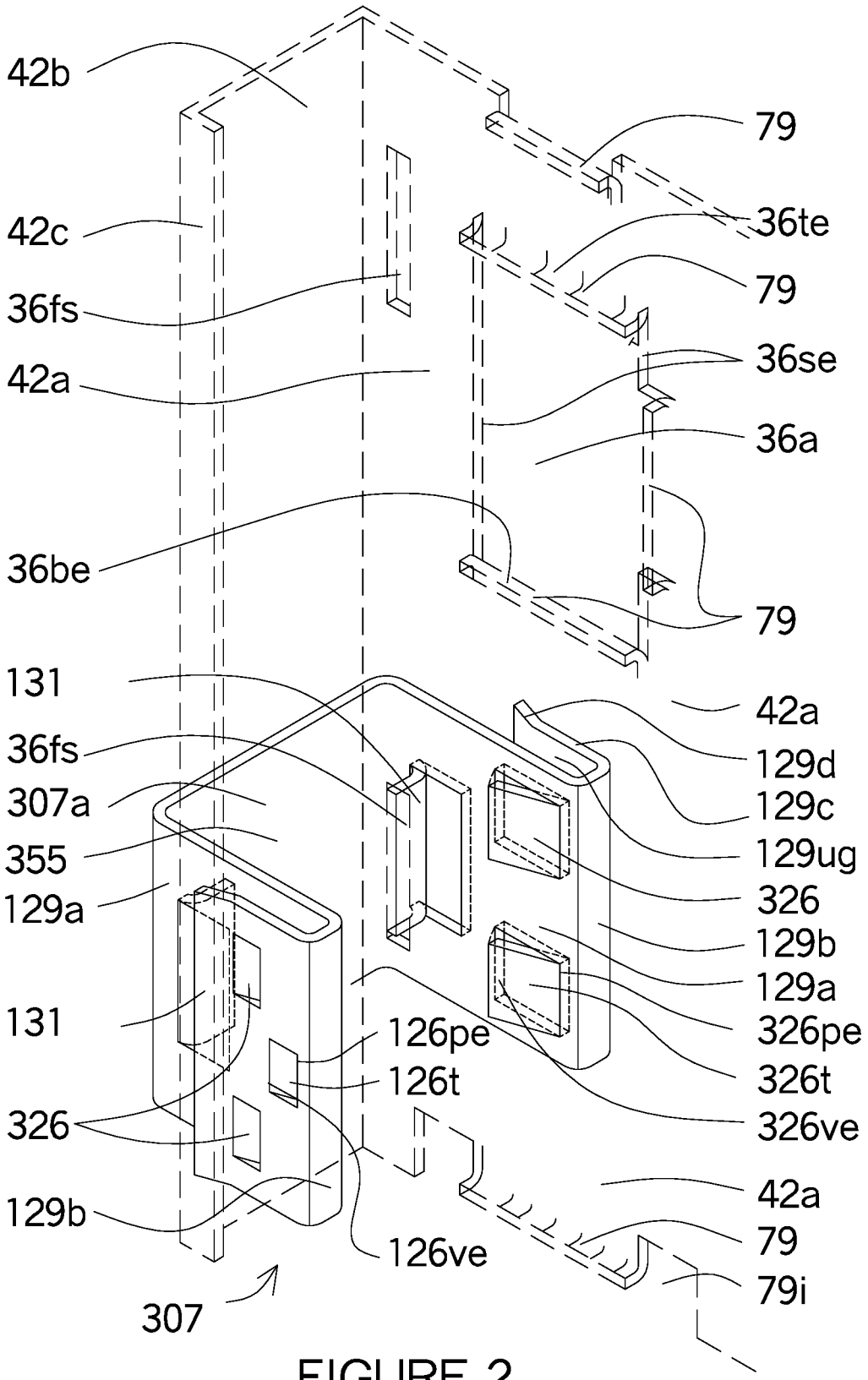
FIG. 2 shows an isometric view of the W-shaped clip wrapped around the flange of the support member being secured by the lip and a slot hole in the web and the ledges at the top end and bottom end of the support member as well as at the hole.

FIG. 2 shows an isometric view of a vertical support member shown as a C channel 42 having a web 42*a*, flanges 42*b* and lips 42*c*. The web 42*a* shows a ledge 79 at the top end and bottom end of the web 42*a* as well as an ledge indentation 79*i* at the bottom edge. A slot hole 36*s* is shown setback from the flange 42*b* the same distance as the length of the lip 42*c* from the flange. A hole 36 is shown in the web 42*a* having ledges 79 at the hole bottom edge 36*be*, hole side edge 36*se* and the hole bottom edge 36*be* where the ledges 79 can be engaged to the tabs 326*t* of the punched out tabs 326. Near the bottom of the support member is a W-shaped clip 307 have its web 307*a* installed parallel to the flange 42*b* of the support member and has two hook receivers 129 attached at both ends with their ventral side wrapped around the web 42*a* and lips 42*c* of the support member also referred to as the anchor space 355. The hook receivers 129 have a first leg 129*a* that is parallel to the lip 42*c* or web 42*a* with a second leg 129*b* extending perpendicular then a third leg 129*c* extending back to the flange 42*b* and parallel to the first leg 129*a* leaving a receiver U-gap 129*ug* gap 45 between the first leg 129*a* and the third leg 129*c*. Both the first legs 129*a* have punched out hooks 131 where one side is installed at the side edge of the lip 42*c* and the opposite punched out hooks 131 are inserted into the flange-slot hole 36*fs* along with additional punch out tabs 326 where the tab 326*t* will exert pressure on the web 42*a* to secure the W-shaped clip 307 to the support member. Additional punched out tabs 326 have their has the vent edge 326*ve* of the tabs 326*t* pivot toward the support member to apply pressure to the web 42*a* of the support member and slanted so the pivot edge 326*pe* is the pivot point for the tab 326*t* away from the vented edge 326*ve*. The slanted angle of the tab 326*t* allows the tab 326*t* to smoothly be inserted over the support member. The hook receiver 129 has a hook tongue 128 (not shown) inserted into the receiver U-gap 129*ug* between the first and third legs 129*a* & 129*c* so the pivot edge 326*pe* of the tab 329*t* has the pivot end on the left side or pivot edge 326*pe* extending ventrally inward away from the vented edge 326*ve* or right side. The slanted angle of the tab 326*t* makes the hook tongue 128 easier to slide between the first and third legs 129*a* & 129*c* as shown in FIG. 5 when the W-shaped clip 307 is in a horizontal position.

Figure 3:
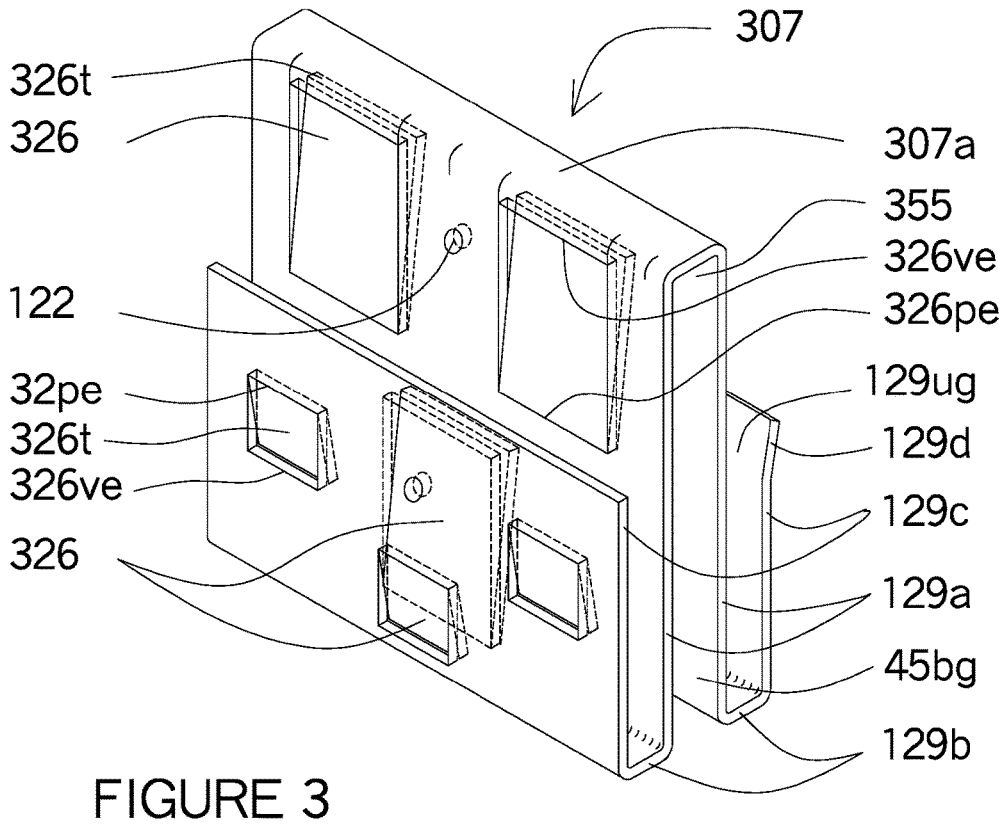
FIG. 3 shows an isometric view of the W-shaped clip in a horizontal orientation having a hook receiver on both sides of the W-clip with the tabs extended from the punch out tabs.
Figure 5:
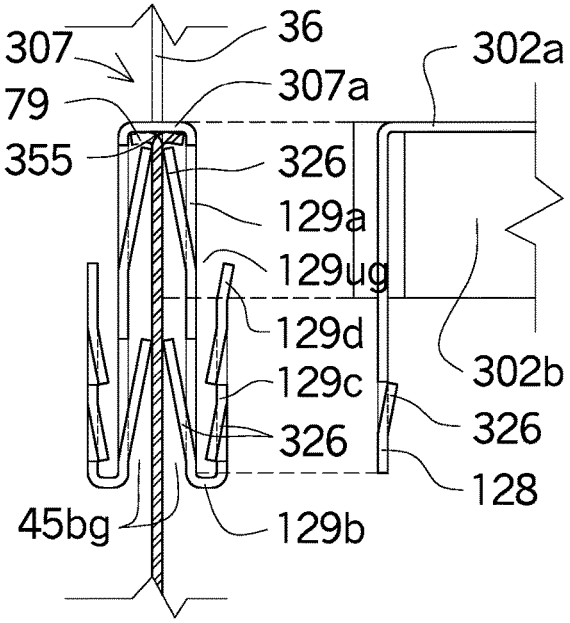
FIG. 5 shows a cross section view of the W-shaped clip installed at the hole in a support member having a ledge on the bottom edge with the hook receivers on both sides and where one side has a hook tongue of U shaped spacer brace positioned to be installed in the hook receiver.

FIG. 3 shows an isometric view of the W-shaped clip 307 which is used in FIGS. 5, 8, 11 and 12 except in FIG. 3 punched out tabs 326 have been installed. The W-shaped clip 307 is shown with two hook receivers 129 extending from both sides where each hook receiver 129 has a first leg 129*a* extending downward with a second leg 129*b* extending outward with a third leg 129*c* extending upward forming a gap 45 between the first and third leg 129*a* & 129*c* leaving an anchor space 355 on the ventral side between the first leg 129*a* of each hook receiver 129. The first leg 129*a* has three punched out tabs 326 so the tab 326*t* extend ventrally inward so the pivot edge 326*pe* is the pivot point and the tab 326*t* is slanted inwardly from the vented edge 326*ve*. Three punched out tabs 326 also occur on the third leg 129*c* however here the pivot edges 326*pe* are on top end and the vented edges 326*ve* are on the bottom. The space between the first leg 129*a* of each hook receiver 129 and the third leg 129*c* has a U-gap receiver 129*ug* as shown in FIG. 5 for the hook tongue 128 to fit into. The upper punched out tabs 326 has the tabs 326*t* extending downward so the lower edge protrudes so when the hook tongue 128 from an adjacent U shaped spacer brace 302 is inserted into the gap 45, the tab 326*t* from the punched out tabs 326 will engage the tabs 326*t* from the third leg 129*c*. The punched out tabs 326 in the hook tongue 128 have the pivot edges 326*pe* on the bottom so the tab 326*t* can be inserted into the gap 45 and have the edge of the tab 326*t* at the vented edge 326*ve* engage the edge of the tab 326*t* at the vented edge 326*ve* from the third leg 129*c* of the hook receiver 129. The lower punched out tab 326 in the third leg 129*c* of the hook receiver 129 is there to help stabilize the hook tongue 128 when installed in the hook receiver 129. The W-shaped clip 307 shown in FIG. 5 shows the ventral side of the web 307*a* installed in the anchor space 355 which is the over the bottom edge of the hole 36. The bottom edge of the hole 36 shows a ledge 79 which is a portion of the web 42*a* bent at an angle preferably 90 degrees to form a shelf. The ledge 79 is used to support the W-shaped clip 307 above and support the tab 326*t* from the punched out tab 326 shown in the first leg 129*a* of the hook receiver 129. The ledge 79 can be bent to extend to the left or right side of the web 42*a* and the tab 326*t* is used to secure the ledge 79 from being lifted above the ledge. The tabs 326*t* prevent the W-shaped clip 307 from moving horizontally and the tabs 326*t* on both sides of the hook receiver 129 allow the W-shape clip 307 to be installed in either direction. Since the W-shaped clip 307 is installed in the hole 36, the horizontal movement of the W-shaped clip 307 is engaged by the hole side edges 36*se* of the hole 36 thereby eliminating any movement of the W-shaped clip 307 within the hole 36.

Figure 4:
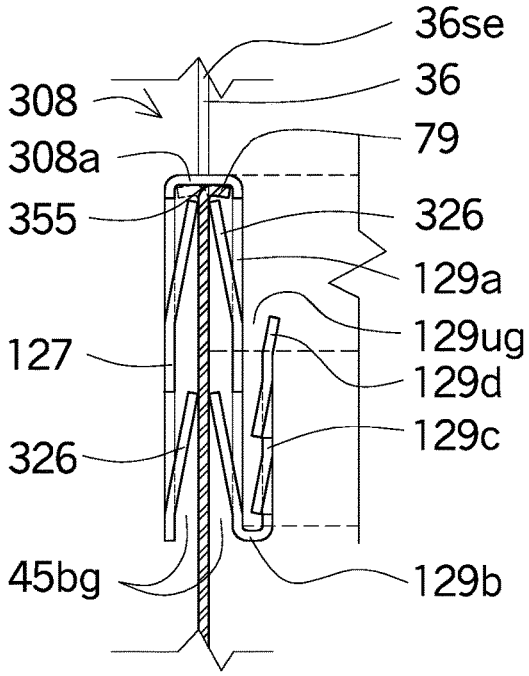
FIG. 4 shows a cross section view of the U-shaped clip installed at the a hole in a support member having a ledge on the bottom edge and overhangs the right side of the web.
Figure 7:
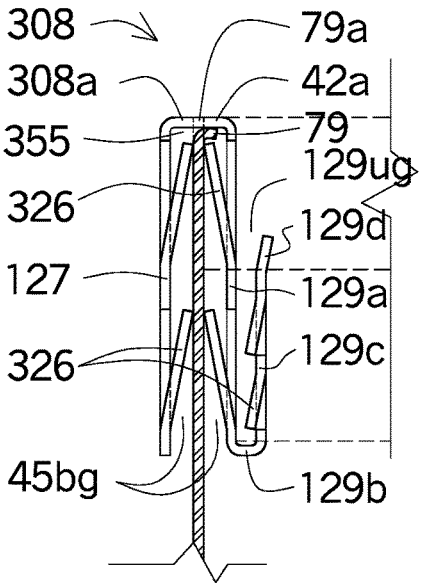
FIG. 7 shows a cross section of a U-shaped clip installed over the web of the support member ledge at the top end of a support member being secured by the punch out tab under the ledge.
Figure 10:
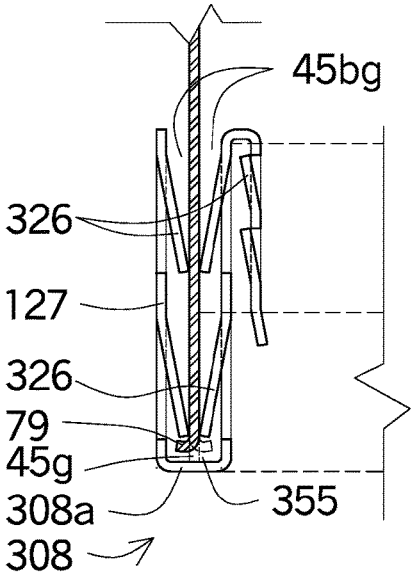
FIG. 10 shows a similar cross section as FIG. 7 however the ledge is facing the opposite direction and the U-shaped clip is resting on the web of the support member.

FIGS. 4, 7 & 10 show U-shape clips 308 where the top side is a web 308*a* and has a hook finger 127 extending from one side and a hook receiver 129 extending on the opposite side with and anchor space 355 between the hook finger 127 and the hook receiver 129. The hook finger 127 secures only one side of the U-shaped clip 308, however looks exactly like the first leg 129*a* of the hook receiver 129 in FIG. 5. The hook receiver 129, ledge 79 and the punched out tabs 326 all function the same as in FIG. 5 except as previously noted the U-shape clip 308 is used when no additional spacer braces are required to be connected in tandem.

Figure 6:
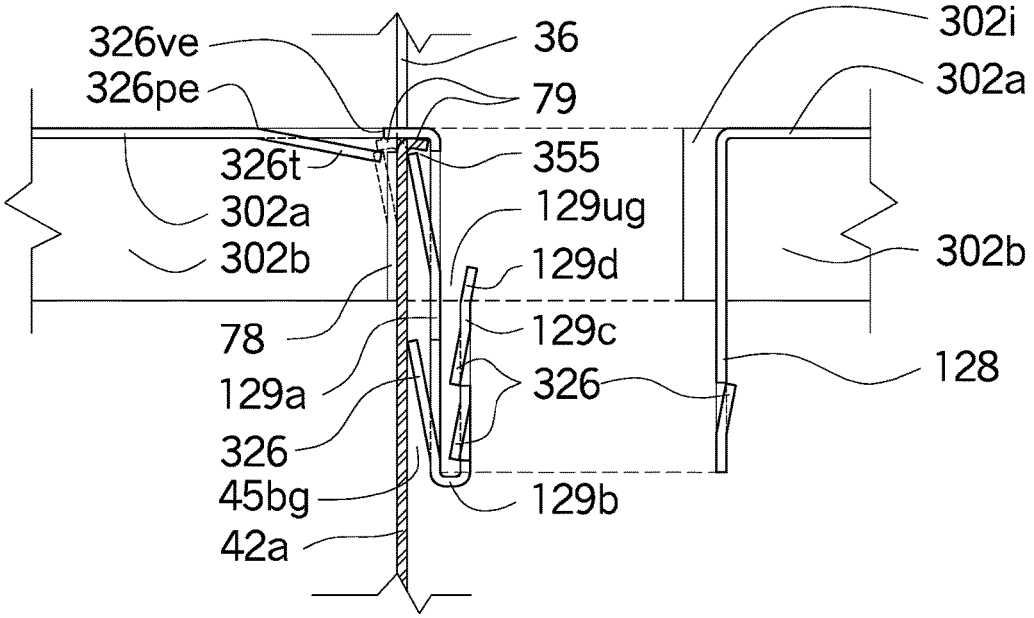
FIG. 6 shows a cross section of a spacer brace having the hook receiver end installed over the ledge extending on the right side of the web and the opposed end of an adjacent spacer brace having a hook tongue end positioned to be installed into the hook receiver end with each end having punched out tabs that interlock between each other and the tab of the punch out tab on the first leg of the hook receiver engage the underside of the ledge at the hole.

FIG. 6 is the opposing end of the U shaped spacer brace 302 shown in FIG. 5 where the opposite end was a hook tongue 128 and this figure shows a hook receiver 129 extending through the hole 36. The U shaped spacer brace 302 can be wider than the hole 36 where the flanges 302*b* abut one side of the web 42*a* of the support member or can be narrower than the width of the hole 36 where in this case a punched out tab 326 is shown at the web of the U shaped spacer brace 302. The punched out tab 326 has the pivot edge 326*pe* away from the hole 36 while the vented edge 326*ve* close to the hole 36 so the tab 326*t* can be slanted ventrally so the end of the tab 326*t* can extend under the ledge 79 that extends outwardly from the hole bottom edge 36*be* also shown as the anchor space 355. As explained later the ledge 79 can be the full width of the hole 36 or smaller as long as the tab 326*t* can support the U shaped spacer brace 302 from moving upwardly away from this secured connected. Even though the U shaped spacer braces 302 are equal to the spacing between support members, the hook receiver 129 passes over the web 42*a* and the hook tongue 128 is installed into the hook receiver 129.

Figure 8:
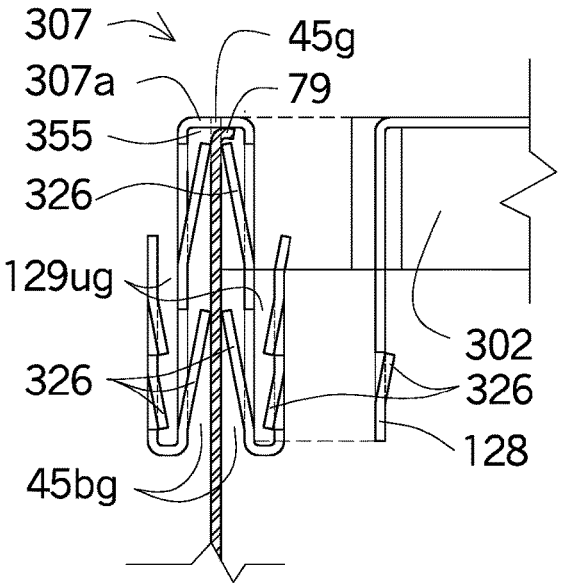
FIG. 8 shows a cross section of a W-shaped clip installed over the web of the support member with the tab of the punch out tab engaging the ledge and a hook receiver end with its punch out tabs shown adjacent to the hook tongue of an adjacent spacer brace along with its punch out tabs ready to be locked together with the tabs in the hook receiver.
Figure 9:
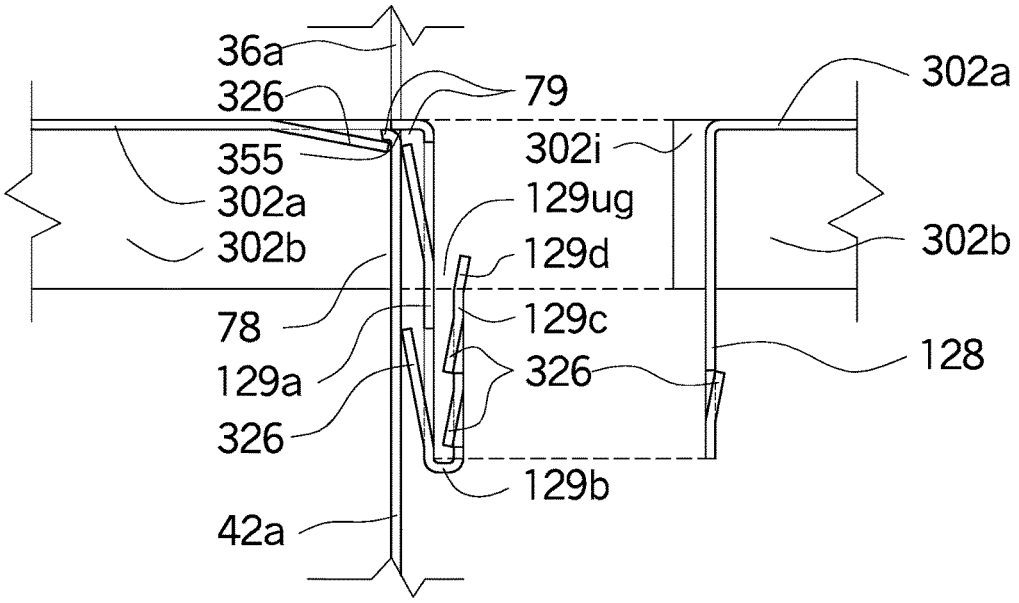
FIG. 9 shows a similar cross section as FIG. 6 however the ledge is facing the opposite direction.
Figure 11:
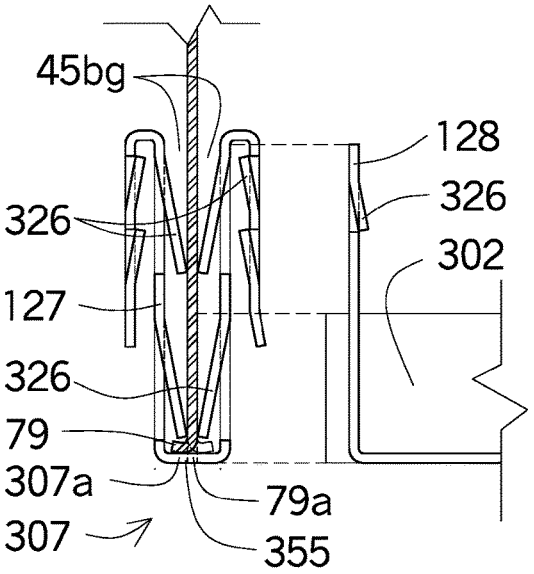
FIG. 11 shows a W-shaped clip installed in the ledge gap with the tab securing the ledge and the hook tongue of the adjacent spacer brace ready to be installed against the protruding tabs of the punched out tabs of the hook receiver.

FIGS. 7-9 show the ledge 79 extending to the left or right allowing the clips or spacer braces to be installed in either direction. On the other hand FIGS. 10-11 show the U-shape clip 308 and the W-shaped clip 307 where the anchor space 355 is different. FIG. 10 shows the web 308*a* of the U-shaped clip 308 resting on the web 42*a* also referred to here as the anchor space 355 of the C channel 42 and the ledge 79 is slightly elevated leaving a ledge gap 45*g* under the ledge 79. On the other hand, in FIG. 11 the ledge gap 45*g* has the web 307*a* of the W-shaped clip 307 resting on the anchor space 355. Since the ledge 79 is bent outwardly, the ledge 79 can be wider than the W-shaped clip 307 which allows the web 307*a* to be installed in the ledge gap 45*g*. The same hook tongue 128 from FIG. 5 is installed except here the U shaped spacer brace 302 has the dorsal side used as a base plate and is secured to a floor. It should also be noted that the ledge 79 is not occurring at a hole 36 as previously shown but at a floor line or at the top of a support member as shown in FIG. 2.

Figure 12:
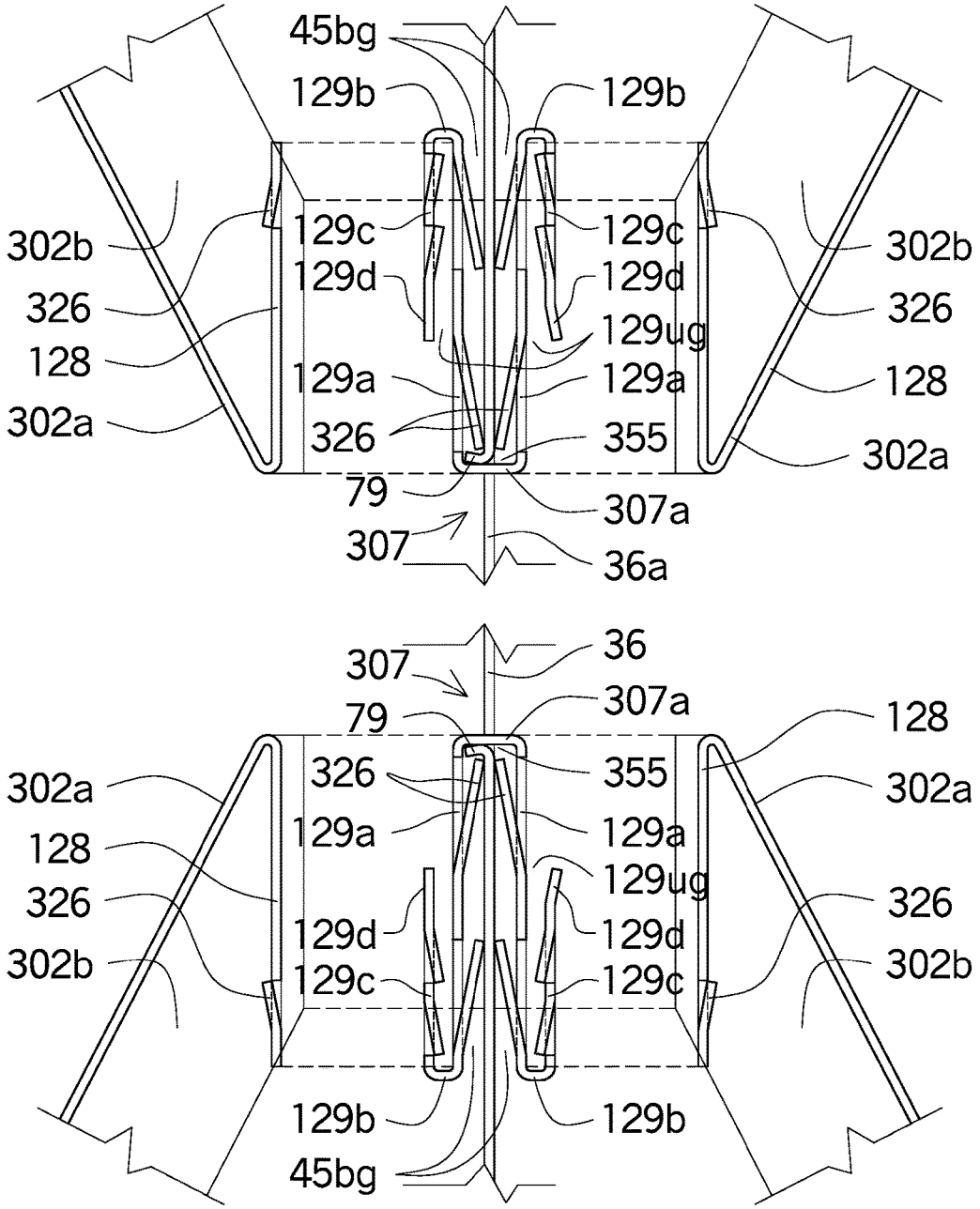
FIG. 12 shows a W-clip installed over the bottom and top ledges of the hole in the support member and four diagonal spacer braces having the hook tongue ends installed into the hook receiver ends of the W-clips.

FIG. 12 is a combination of FIGS. 8 & 11 except two W-shaped clips 307 are installed one at the hole top edge 36*te* and another at the hole bottom edge 36*be* of the hole 36 and each edge is shown having a ledge 79. In addition, each hook receiver 129 shows a U shaped spacer brace 302 with their hook tongue 128 end ready to be installed into the U-gap receiver 129*ug* between the first leg 129*a* and the third leg 129*c*. The punched out holes 326 and the tabs 326*t* in both the third leg 129*c* and the hook tongue 128 are aligned so the tab 326*t* edges abut one another as so neither one can be removed vertically once installed into the U-gap receiver 129*ug*. The W-shaped clip 307 cannot move horizontally in either direction because the W-shaped clips 307 have the web also referred to as the third wall engage the hole side edges 36*se* of the holes 36 and the tabs 326*t* of the punched out tabs 326 engage the bottom edge of the ledge 79 that also presses against the sides of the web 42*a* of the support member to eliminate horizontal movement.

Figure 13:
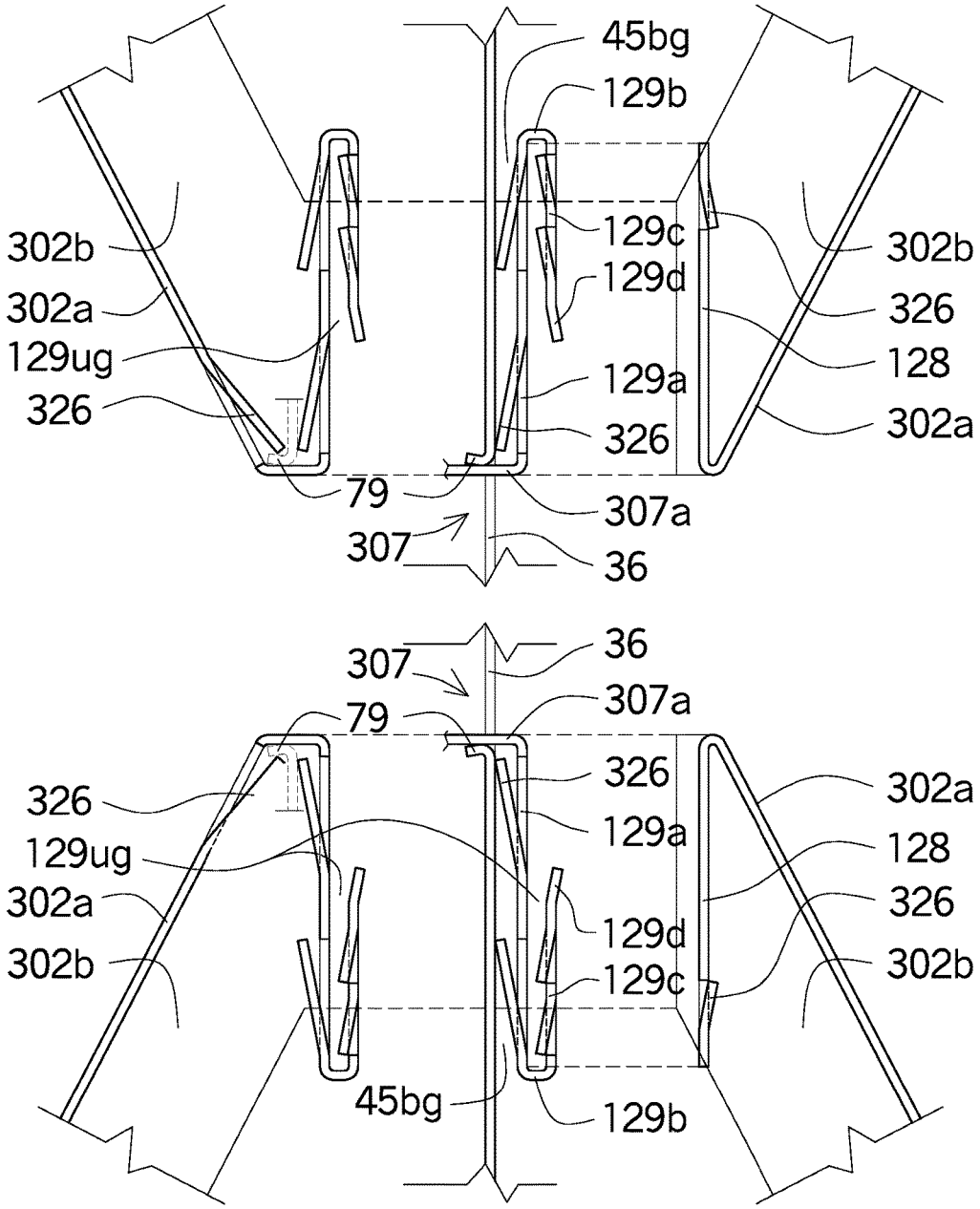
FIG. 13 shows a diagonal spacer brace with the hook receiver end passing through the hole over the ledge and an adjacent diagonal spacer brace with its hook tongue end connecting to the hook receiver end of the adjacent spacer brace along with another diagonal spacer brace with the hook receiver end passing through the hole over the ledge and an adjacent diagonal spacer brace with its hook tongue end connecting to the hook receiver end of the adjacent spacer brace.

FIG. 13 is similar to FIG. 12 as four U shaped spacer braces 302 intersect at a hole 36 except here one U shaped spacer brace 302 has the hook receiver 129 end extend over the hole top edge 36*te* and the hole bottom edges 36*be* and the adjacent U shaped spacer brace 302 has the hook tongue 128 end secured into the U-gap receiver 129*ug* between the first leg 129*a* and the third leg 129*c* of the hook receivers 129 The U shaped spacer braces 302 are shown with angled hook receiver 129 and angled hook tongues 128. Referring back to FIG. 1 the diagonal spacer braces could be used in any one of the cloud formations from either FIG. 12 or FIG. 13 depending if a continuous U shaped spacer brace 302 was to be used or whether an X shaped metal framing configuration is desired. In addition the ledge 79 and punched out tabs 326 were used to stabilize the framing structure. Because of the angle of the U shaped spacer brace 302, the punched out tab 326 is shown in the web 302*a* so the vented edge 326*ve* has the tab 326*t* directed at the underside of the ledge 79 to secure the U shaped spacer brace 302 from sliding off the ledge 79.

Figure 14:
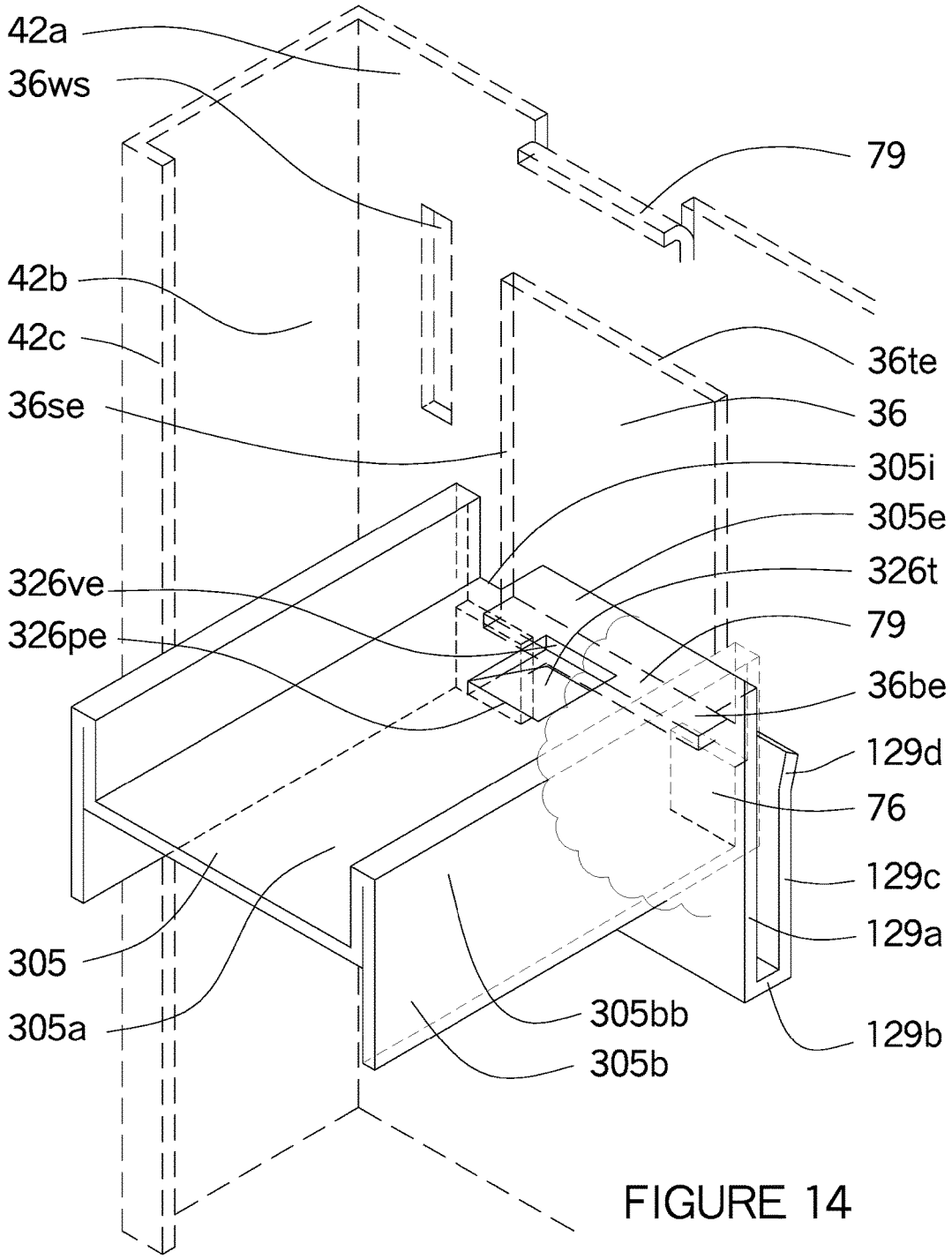
FIG. 14 shows an I-shaped spacer brace with the hook receiver end passing through the hole onto the ledge at the bottom edge of the hole in the support member with the ledge extending away from the hook receiver end with the tab of the punch out tab extending under the ledge and engaging the bottom edge of the ledge.

FIG. 14 shows an isometric drawings of an I-shaped spacer brace 305 which is shown wider than the hole 36 and where the hole 36 has a ledge 79 located on the bottom edge and the ledge 79 is not the full width of the hole bottom edge 36*be*. As in the previous figure a punched out hole 326 has the pivot edge 326*pe* away from the hole 36 and the vented edge 326*ve* close to the ledge 79 so the tab 326*t* can penetrate under the ledge 79 and two flaps 76 are show that extend from the flange 305*b* ventrally so the flaps 76 rest against the web 42*a* and under the ledge 79.

Figure 15:
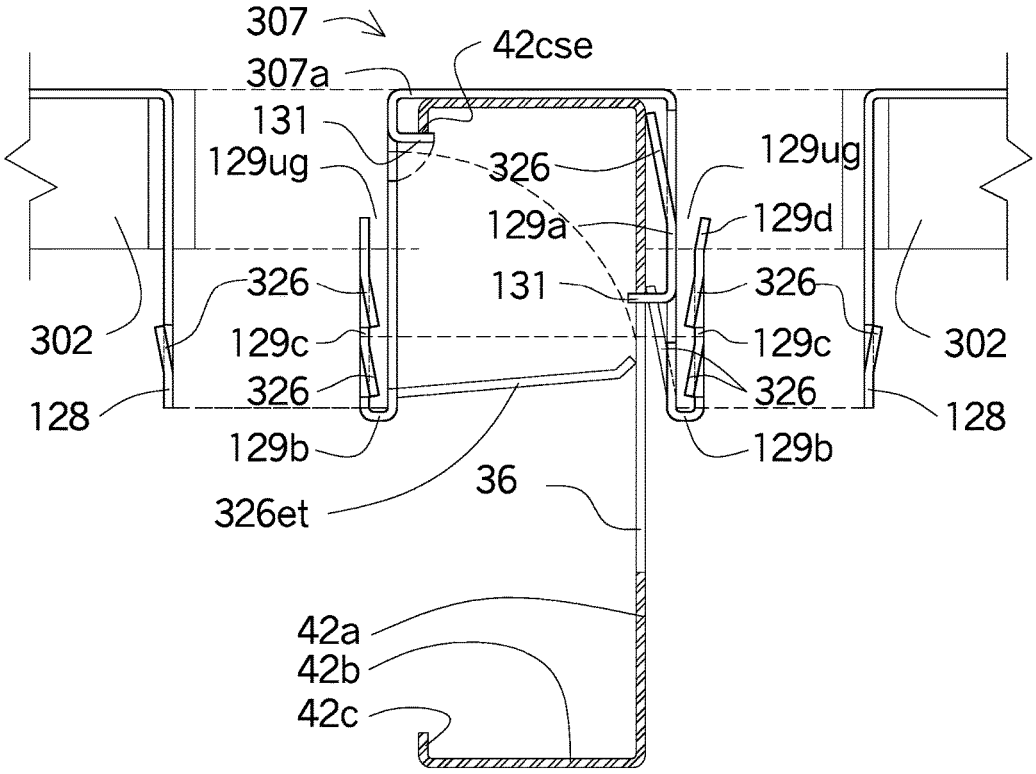
FIG. 15 shows a plan view of a W-shaped clip installed over the flange of a C channel having hook tongues installed into the hook receivers on both sides of the W-shape clip.

FIG. 15 is a plan view of FIG. 2 where the punched out hooks 131 wrap around the lip 42*c* and an extended tab 326*et* extends from the first leg 129*a* of the hook receiver 129 so the extended tab 326*et* can brace the hook receiver 129 on the interior side of the C channel 42. On the outer side of the C channel 42 a hook receiver 129 extends from the web 307*a*, however here another punched out hook 131 is shown inserted into the hole 36 in the web 42*a*. The punched out hooks 131 and the tabs 326*t* from the punch out tabs 326 help secure the W-shaped clip 307 around the flange 42*b* and around the lip side edges 42*cse* of the lip 42*c* On both sides of the W-shaped clip 307 are the hook tongue 128 ends of the two adjacent U shaped spacer braces 302.

Figure 16:
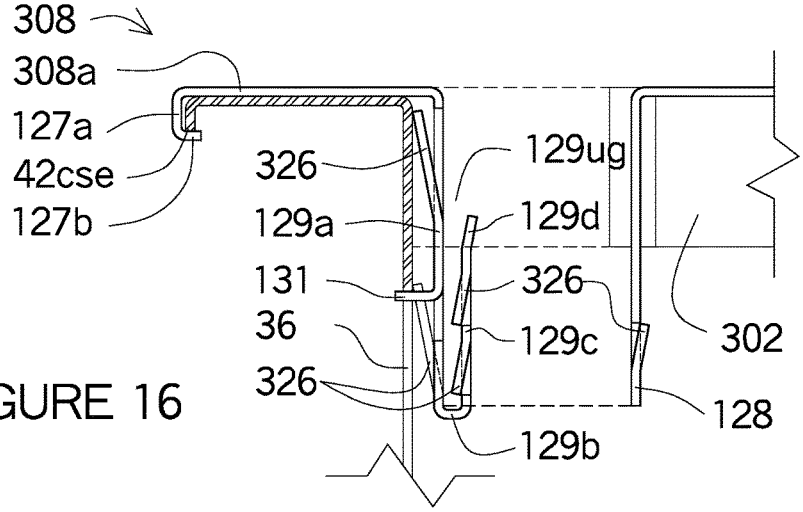
FIG. 16 shows a plan view of a U-shaped clip installed over the flanged of a C channel having one side hook over the lip of the support member and the opposite side having a bent hook extend into the hole in the web of the support member with a hook tongue end of a spacer brace.

FIG. 16 is a plan view of a U-shaped clip 308 wrapped around the flange 42*b* of the C channel 42. Instead of the punched out hooks 131 in FIG. 15 the hook finger 127 end has the first leg 127*a* abut the lip 42*c* and the second leg 127*b* turn under the lip 42*c*. The U-shaped clip 308 has the hook finger 127 installed first so as to rotate the U-shaped clip 308 into place and the punched out tabs 326 with its tabs 326*t* press against the web 42*a* at the first leg 129 of the hook receiver 129 against the web 42*a* to allow the second punched out hook 131 to be installed into the hole 36 of the C channel 42. The hook tongue 128 from an adjacent U shaped spacer brace 302 is shown ready to be installed into the hook receiver 129.

Figure 17:
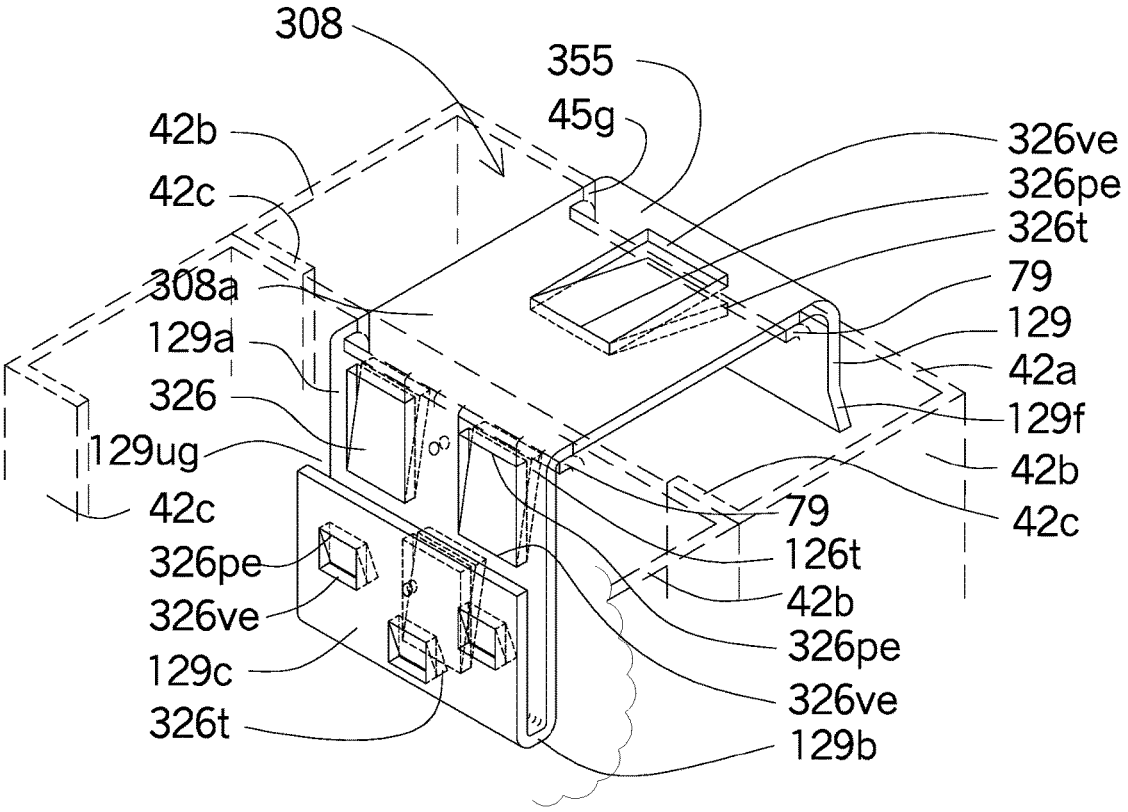
FIG. 17 shows an isometric view of a U-shaped clip spanning over the end of two support member connected at the web and ledges and the tabs of the punch out tabs in the U-shaped clip.

FIG. 17 is an isometric view where the U-shaped clip 308 fits over the top edge of two C channel 42 where the web 42*a* has a ledge 79 bent at the top edge of the web 42*a*. The ledge 79 is shown wider than the U-shaped clip 308 so the web 308*a* is inserted into the ledge gap 45*g* which will allow the dorsal side of the U-shaped clip 308 to be level with the top edge of the support member shown as a C channel 42. Since the U-shaped clip 308 is spanning over two C channel both having the ledge 79 in the web 42*a*, the rear C channel 42 has a hook finger 127 extend over the web 42*a* of the rear C channel 42. A punched out tab 326 is shown in the web 308*a* where the pivot edge 326*pe* is in the middle between the two C channel 42 and the vented edge 326*ve* is near the ledge 79 so the tab 326*t* can extend under the ledge 79. The opposite end shows a hook receiver 129 extend over the closest C channel 42 where the first leg 129*a* extends over the ventral side of the web 42*a* of the C channel 42 and the punched out tab 326 has the vented edge 326*ve* near to ledge 79, so again the tab 326*t* can extend under the ledge 79. The hook receiver 129 as previously described is engaged to the ventral side of the web 42*a* of the C channel 42.

Figure 18:
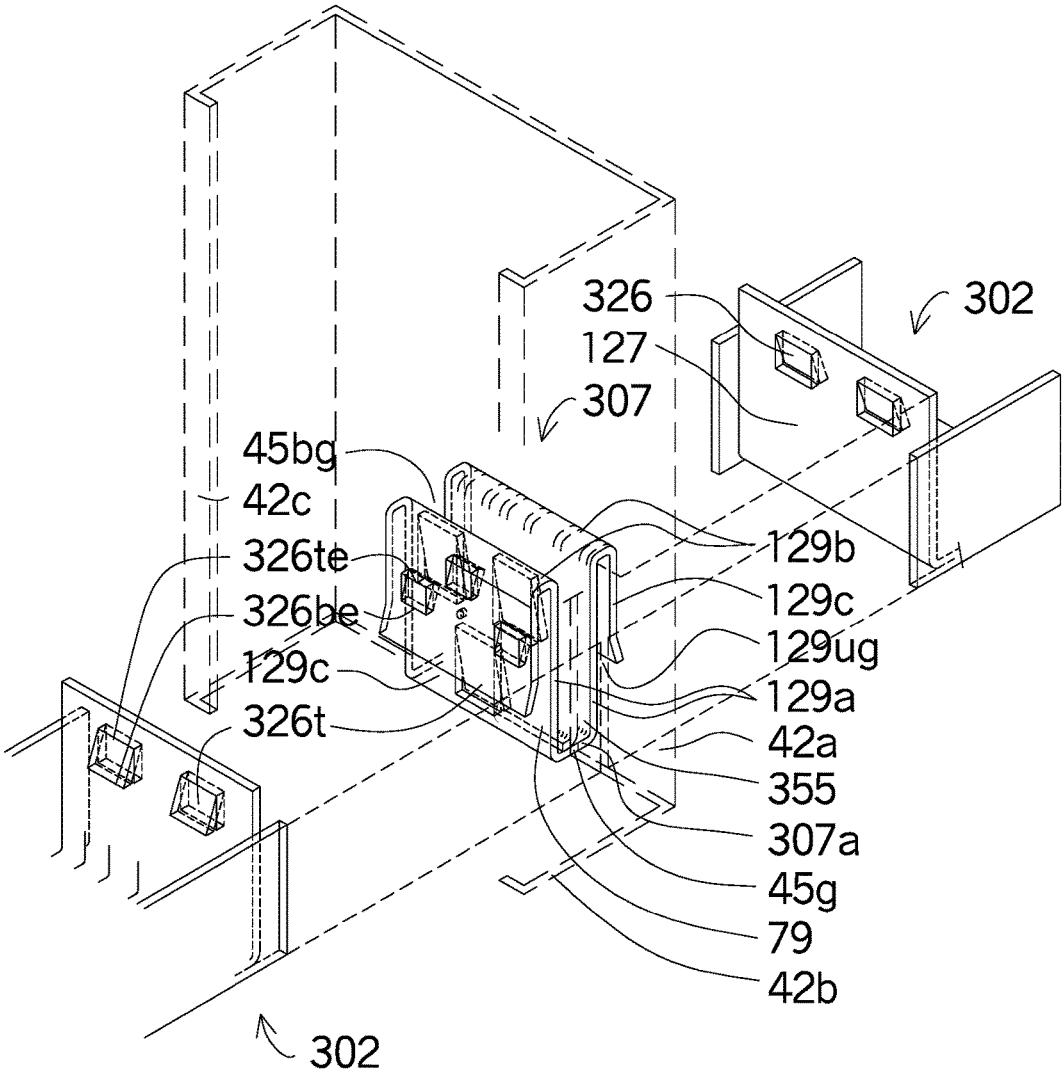
FIG. 18 shows an isometric view of a W-shaped clip at the base of the support member connected by the ledge and the tabs of the punch out holes along with the hook tongue of the spacer brace connecting to the hook receiver ends of the W-shaped clip.

FIG. 18 is an isometric drawing of the sectional view shown in FIG. 11. The isometric view gives a clearer understanding on how the tabs 326*t* at the punched out tabs 326 at the U-shaped clip 308 fit together in the back leg gap 45*ug* between the first leg 129*a* and the third leg 129*c* of the hook receiver 129. In addition the hook tongue 128 is elevated slightly at the web 302*a* & flange 302*b* so the hook tongue 128 can be angled so the hook tongue 128 can slide into the U-gap receiver 129*ug* of the hook receiver 129. After the U shaped spacer brace 302 is installed into the W-shaped clip 307 at the hook receiver 129, the U shaped spacer brace 308 is anchored by an anchor bolt (not shown) to the floor or fastened by screws (not shown). When another support member is installed in a hook receiver 129, the back leg gap 45*bg* is open upward and can easily fit into the back leg gap 45*bg* similar to the schematic diagrams shown in the previous figures.

Figure 19:
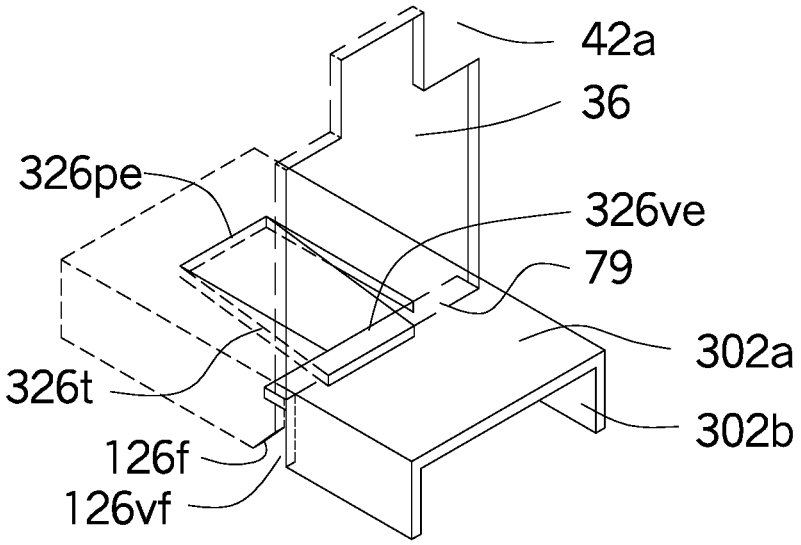
FIG. 19 shows an isometric view of an intermediate connection of a U shaped spacer brace passing through the hole of the support member having the tabs of the punch out holes connect to the ledge along with notches in the flanges connecting the ledge and web of the support member.
Figure 20:
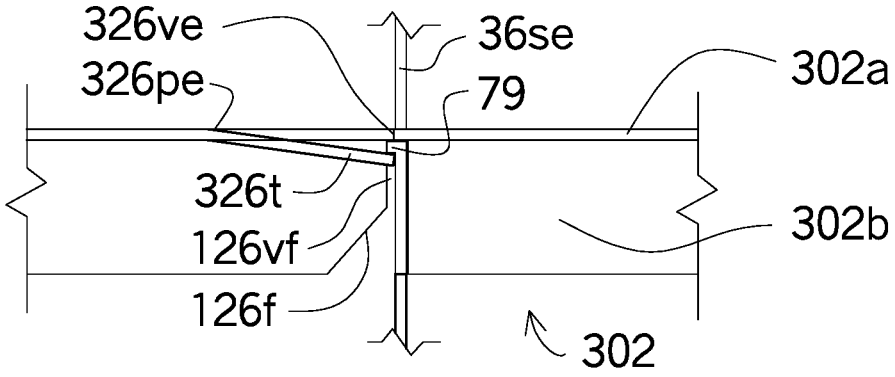
FIG. 20 shows a cross section of FIG. 19.
Figure 21:
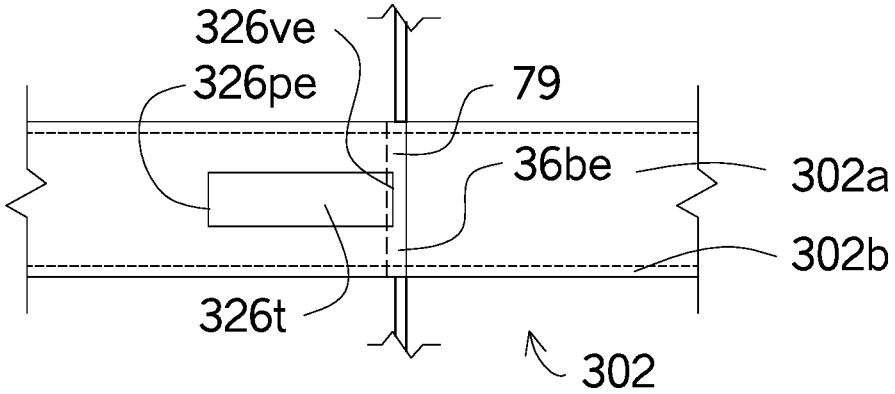
FIG. 21 shows a plan view of FIG. 19.
Figure 22:
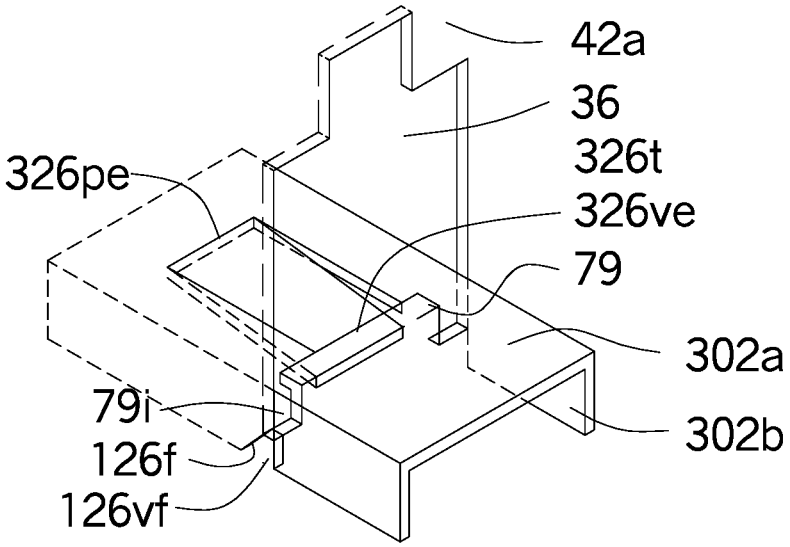
FIG. 22 shows an isometric view of an intermediate connection of a U shaped spacer brace passing through the hole of the support member having the tabs of the punch out holes connect to the ledge along with the flanges having notches in the flanges of the spacer brace for the web of the support member to brace too.
Figure 23:
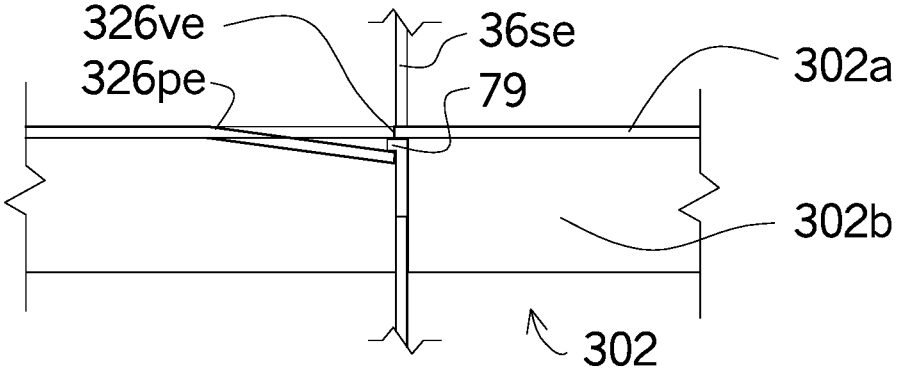
FIG. 23 shows a cross section of FIG. 22.
Figure 24:
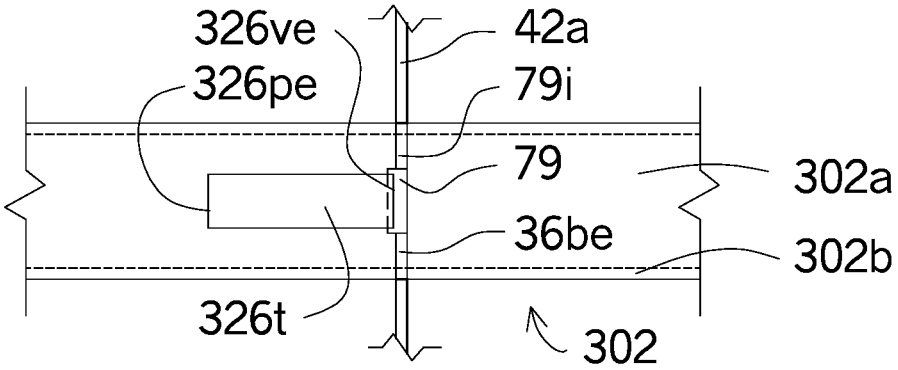
FIG. 24 shows a plan view of FIG. 22.
Figure 25:
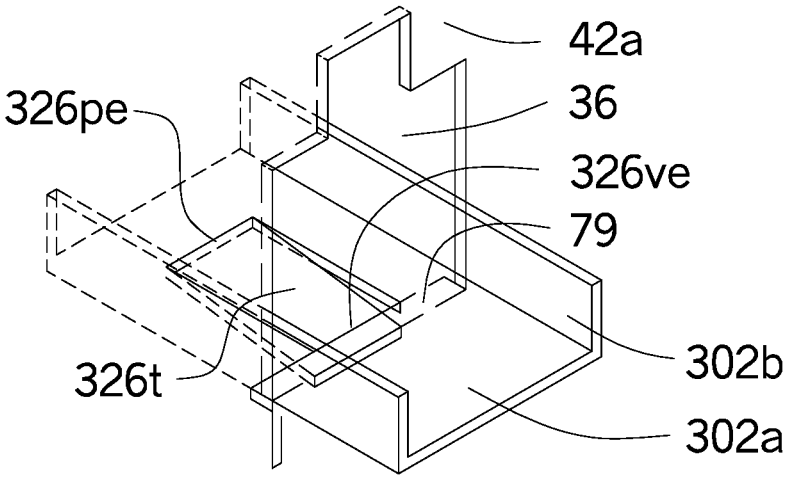
FIG. 25 shows an isometric view of an intermediate connection of a U shaped spacer brace passing through the hole of the support member having the tab of the spacer brace secured under the ledge of the support member.
Figure 26:
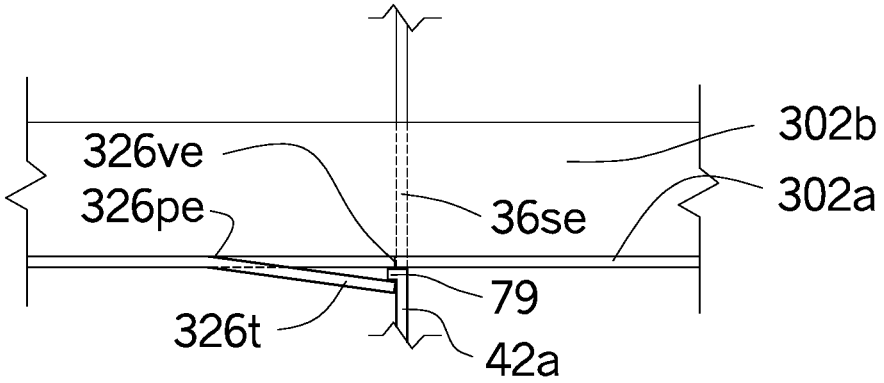
FIG. 26 shows a cross section of FIG. 25.
Figure 27:
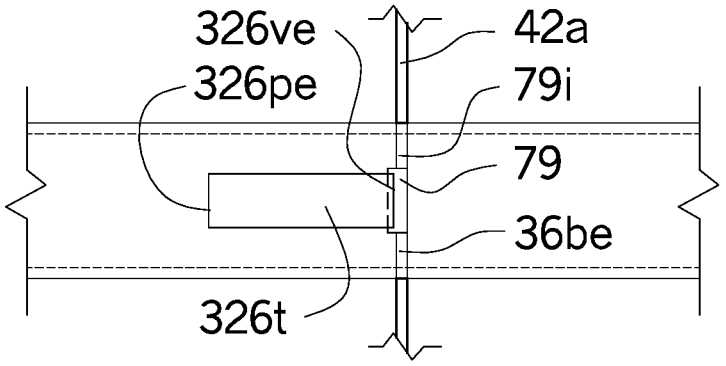

FIGS. 19 through 27 are similar as each group of three figures where each group shows an isometric drawing followed by a cross section and a plan view. FIG. 19 shows a U shaped braces 302 with the ventral side facing the hole bottom edge 36*be* where a full width ledge 79 is shown. The web 302*a* shows the vented edge 326*ve* located near the ledge 79 so the tab 326*t* to be secured at the underside of the ledge 79. In addition, the flanges 302*b* are shown having the vertical flange notches 126*vf* the full depth of the flanges 302*b* to the depth of the top of the ledge 79 and a flare edge 126*f*. FIG. 22 is similar to FIG. 19 except here the ledge 79 is narrower than the width of the hole 36 so the ledge 79 is above the bottom edge of the hole 36 so the flanges 302*b* can slide into the flare 126*f* and secured into vertical-flange notch 126*vf*. FIG. 25 has the U shaped spacer brace 302 so the dorsal side is against the ledge 79. The vented edge 326*ve* is near the ledge 79 so the tab 326*t* can be secured under the ledge 79. The ledge in FIG. 25 can be the full width of the hole 36 or shorter if desired. Any of the U shaped spacer braces 302 can have a ledge indentation 79*i* located close to the ledge 79 so the tab 326*t* from the punched out tab 326 can easily penetrate under the ledge 79 and the vertical-flange notches 126*vf* will not have to penetrate as high into the flange 302*b*.

Figure 28:
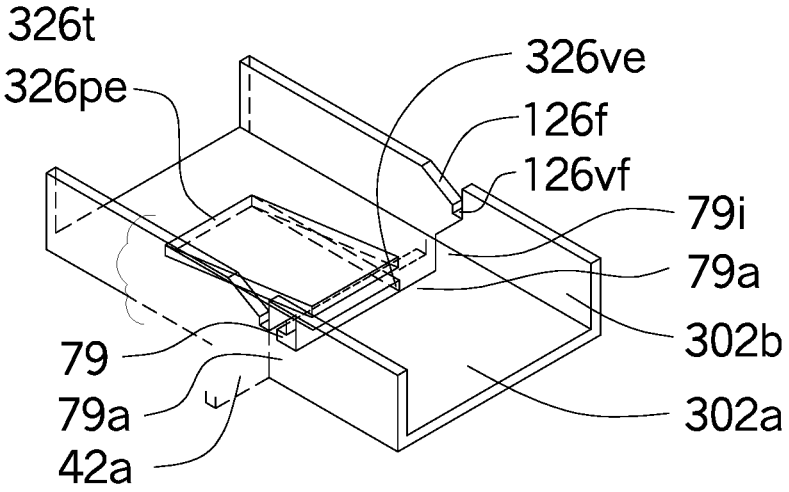
FIG. 28 shows an isometric view of an intermediate connection of a U shaped spacer brace passing under the web of the support member having the tab of the spacer brace secured over the ledge of the support member.
Figure 29:
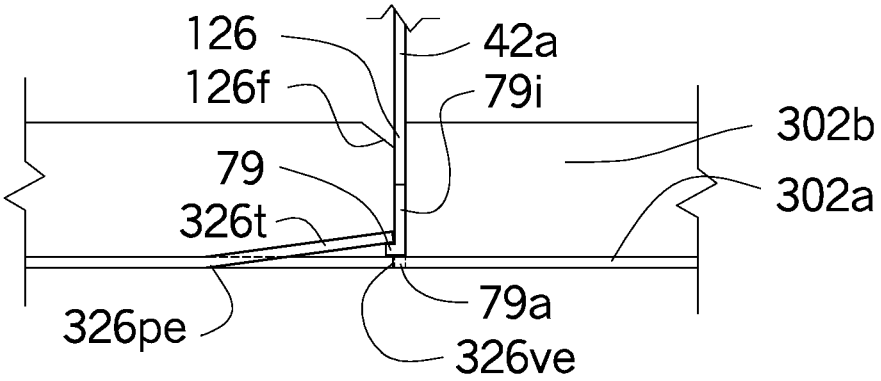
FIG. 29 shows a cross section of FIG. 28.
Figure 30:
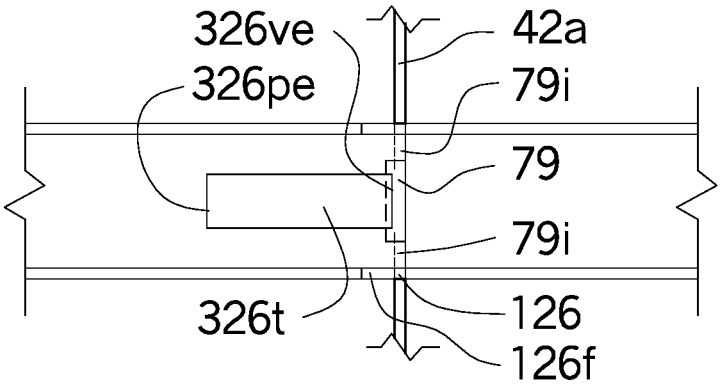
FIG. 30 shows a plan view of FIG. 28.

FIGS. 28-30 show an intermediate connection between the support member shown in FIG. 28 only as the web 42*a* of a C channel 42 and a spacer brace shown as a U shaped spacer brace 302. There can be several support members between the end of the hook receiver 129 of one spacer brace and the hook tongue 128 of an adjacent spacer brace form a longer spacer brace connection as shown in FIG. 1. FIG. 28 shows an isometric drawing of an intermediate connection of a U shaped spacer brace 302 intersecting a C channel 42 shown with only a portion of the web 42*a* shown. The U shaped spacer brace 302 is shown with the dorsal side down facing a floor with the flanges 302*b* extending upward. The web 42*a* shows a ledge 79 at the bottom edge of the support member where a ledge space 79*a* when the ledge 79 is bent to form the ledge 79. The ledge space 79*a* is occupied by the web 302*a* of the U shaped spacer brace 302 and the ledge space 79*a* has a ledge indentation 79*i* on both sides of the ledge 79 and is indented to the height of the bottom edge of the vertical flange notch 126*vf* at the flanges 302*b*. The ledge indentation 79*i* can be the thickness of the flanges 302*b* allowing the ledge 79 to be wider between the two flanges 302*b* or narrower as shown here. Both flanges 302*b* show the vertical-flange notches 126*vf* with a flare 126*f* at one side edge of the vertical-flange notch 126*vf* where the web 42*a* is inserted into the vertical flange notches 126*vf*. When the U shaped spacer brace 302 is slid into the vertical-flange notches 126*vf*, the tab 326*t* of the punched out tab 326 extends over the top side of the ledge 79. The U shaped spacer brace 302 is secured when the tab 326*t* is over the ledge 79 and the web 302*a* is under the ledge 79 and is additional secured when the web 42*a* is secured into the vertical-flange notches 126*vf* and the side edges of the ledge indentation 79*i* is secured to the outside sides of the flanges 302*b*. FIG. 29 shows a section of the connection and FIG. 30 shows a plan view of the connection. FIG. 9 shows a similar wall section except the U shaped spacer braces 302 is shown at a hole 36 rather than upside down on a floor.

Figure 31:
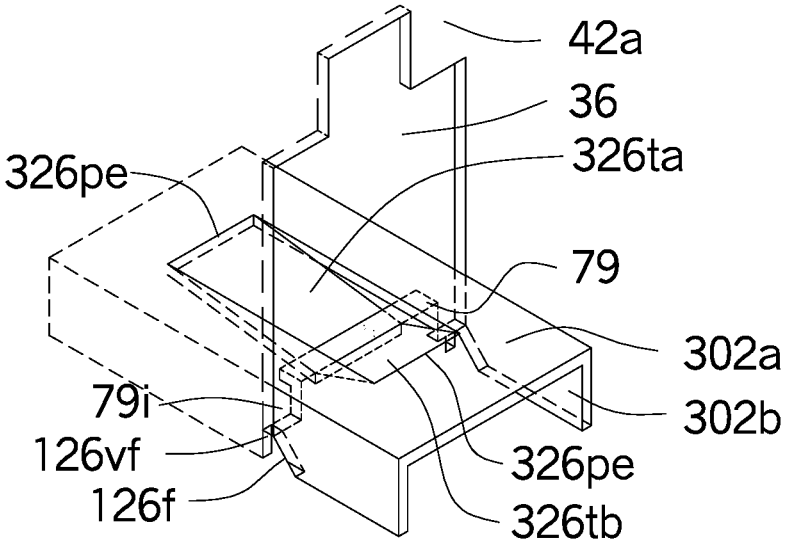
FIG. 31 shows an isometric view of an intermediate connection of a U shaped spacer brace passing through the hole of the support member having two tabs within the same punch out hole with one tab engaging the ledge and the opposing tab engaging the back side along with the flanges having notches in the flanges of the spacer brace for the web of the support member to brace too.
Figure 32:
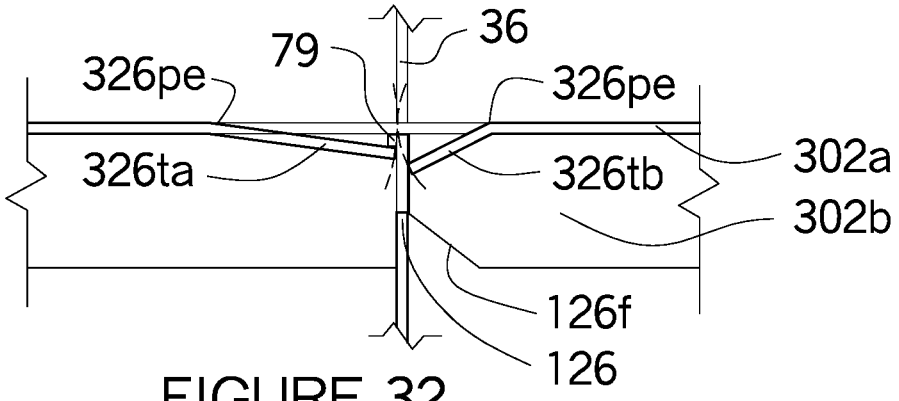
FIG. 32 shows a cross section of FIG. 31.
Figure 33:
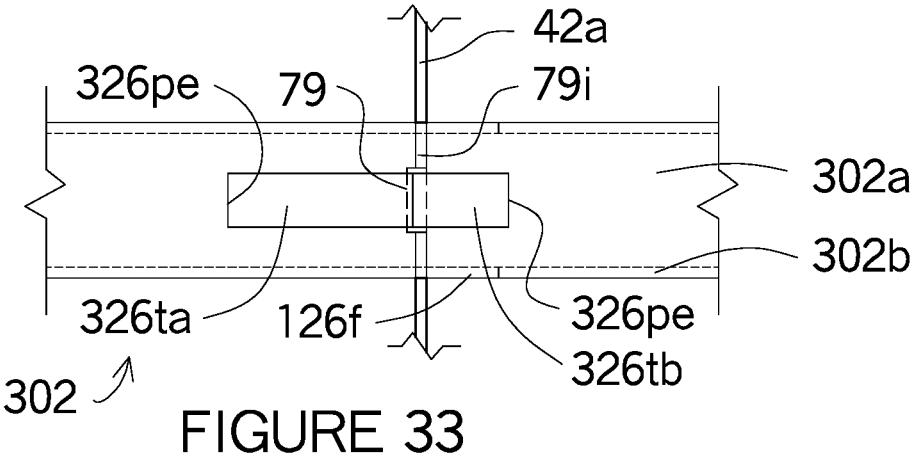
FIG. 33 shows a plan view of FIG. 31.

FIG. 31 is similar to FIG. 22 and shows a larger punched out tab 326 where two different tabs 326*t* as shown. The tab A 326*ta* is shown on the left side of the hole 36 having a pivot edge 326*pe* on the left side of the web 42*a* where the tab A 326*ta* has the end under the ledge 79 shown protruding outward to the left side. The tab B 326*tb* shown on the right side has its pivot edge 325*pe* on the right side of the web 42*a* and the end of the tab B 326*tb* also extends downward so the end of the tab B 326*tb* abuts the right side of the web 42*a*. Both the tabs A 326*ta* and tabs B 326*tb* have their side edges aligned and their front edge abut one another prior to being bent downward to their aligned positions as shown in section FIG. 32. Also shown in FIG. 32 are the flanges 302*b* of the U shaped spacer brace 302 having flares 126*f* at an angle to allow for the bottom edge of the hole 36 to fit into the vertical-flange notches 126*vf* on both sides. The vertical-flange notches 126*vf* are installed midway from the bottom edge of the flanges 302*b* so the top side of the ledge 79 can extend slightly higher to align to the ventral side of the U shaped spacer brace at the web 302*a*. The flares 126*f* are installed on the opposite side of the hole 36 in FIGS. 22 & 25. The U shaped spacer brace 302 will likely be installed with a side motion so the tab A 326*ta* can be slide under the ledge 79 while at the same time the tab B 326*tb* can be pushed downward. FIG. 33 shows a plan view of a C channel 42 with the web 42*a* intersect the U shaped spacer brace 302. If the U shaped spacer brace 302 was reversed with the dorsal side of the web 302*a* facing downward resting on the ledge 79, the tabs A 326*ta* and tabs B 326*tb* would have their vented side edges abut both sides of the web 42*a* eliminating any horizontal movement between support members and the vertical-flange notches 126*vf* would not be required.

Figure 34:
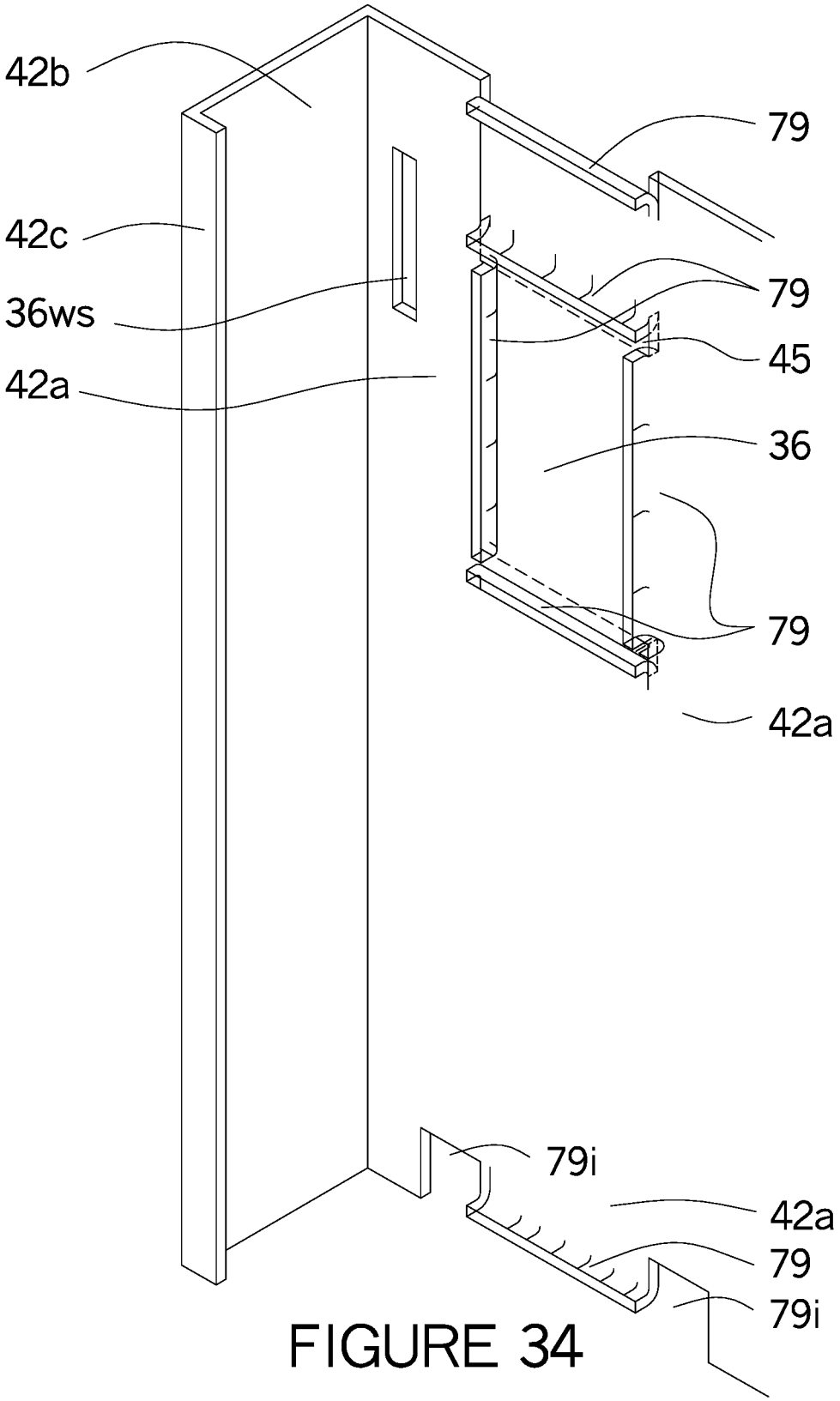
FIG. 34 shows the ledge at the top, bottom and on the side edges of the hole in the web of the support member.

FIG. 34 shows an isometric view of a support member shown as a C channel 42 having a web 42*a* with flanges 42*b* extending ventrally inward with lips 42*c* extending ventrally parallel to the web 42 which is also shown in Cloud A & D in FIG. 1. The web 42*a* shows ledges 79 at the top, bottom and on all four edges of the hole 36. The ledge 79 at the top of the support member extends ventrally inward with the width shown as wide as the hole 36 below; however the length of the ledge 79 can be any length as shown in other figures. The ledge 79 at the bottom of the web 42*a* in the support member is shorter and has a ledge indentation 79*a* on both sides of the punched out tab 326 extending ventrally inward located in the center of the web 42*a*, also shown in FIG. 35. The ledge indentation 79*i* are shown on both sides of the ledge 79 to allow the flanges 302*b* of the U shaped spacer brace 302 to pass through. The ledge 79 in the hole 36 shows the ledge 79 the top and bottom edge to be longer than the hole 36 width. The ledge 79 shown vertically at the hole 36 initially starts to bend at the side edges of the top and bottom ledges 79. The overlapping edges of the ledges 79 allow the ledges 79 to extend to each corner of the hole 36 rather than having a gap of no ledges 79 in the corners of the hole 36. Another hole shown as a vertical oriented web-slot hole 36*ws* is installed in the web 42*a* the edge of the lip 42*c* is setback the same distance from the web 42*a*. The web-slot hole 36*ws* is shown in FIG. 2 and is used to a W-shaped clip 307 extending over the flanges as shown in FIG. 2.

Figure 35:
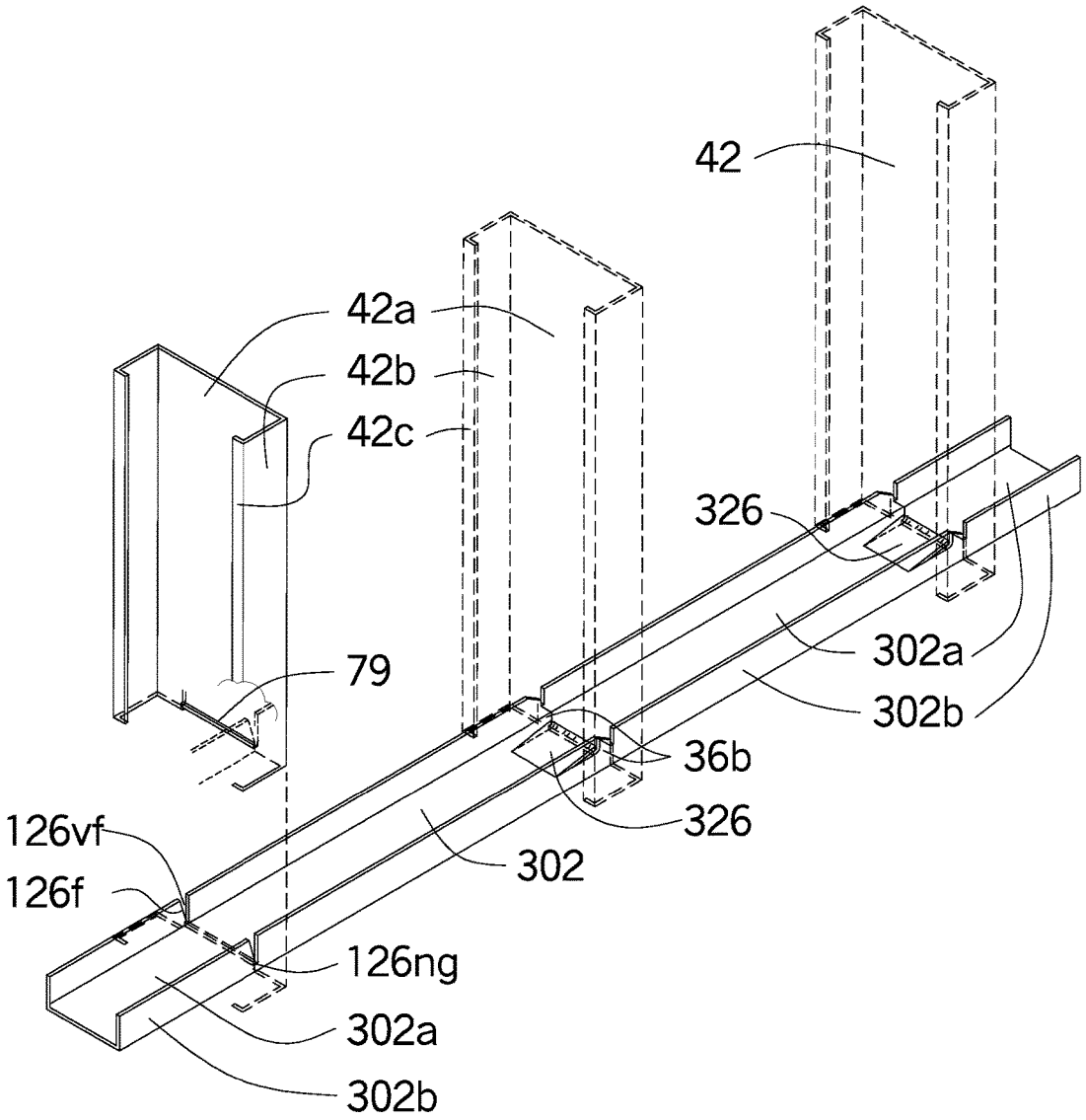
FIG. 35 shows the ledge being inserted into the ledge gap of the flanges of the U shaped spacer brace as well as the tab of the punched out holes in the web.
Figure 36:
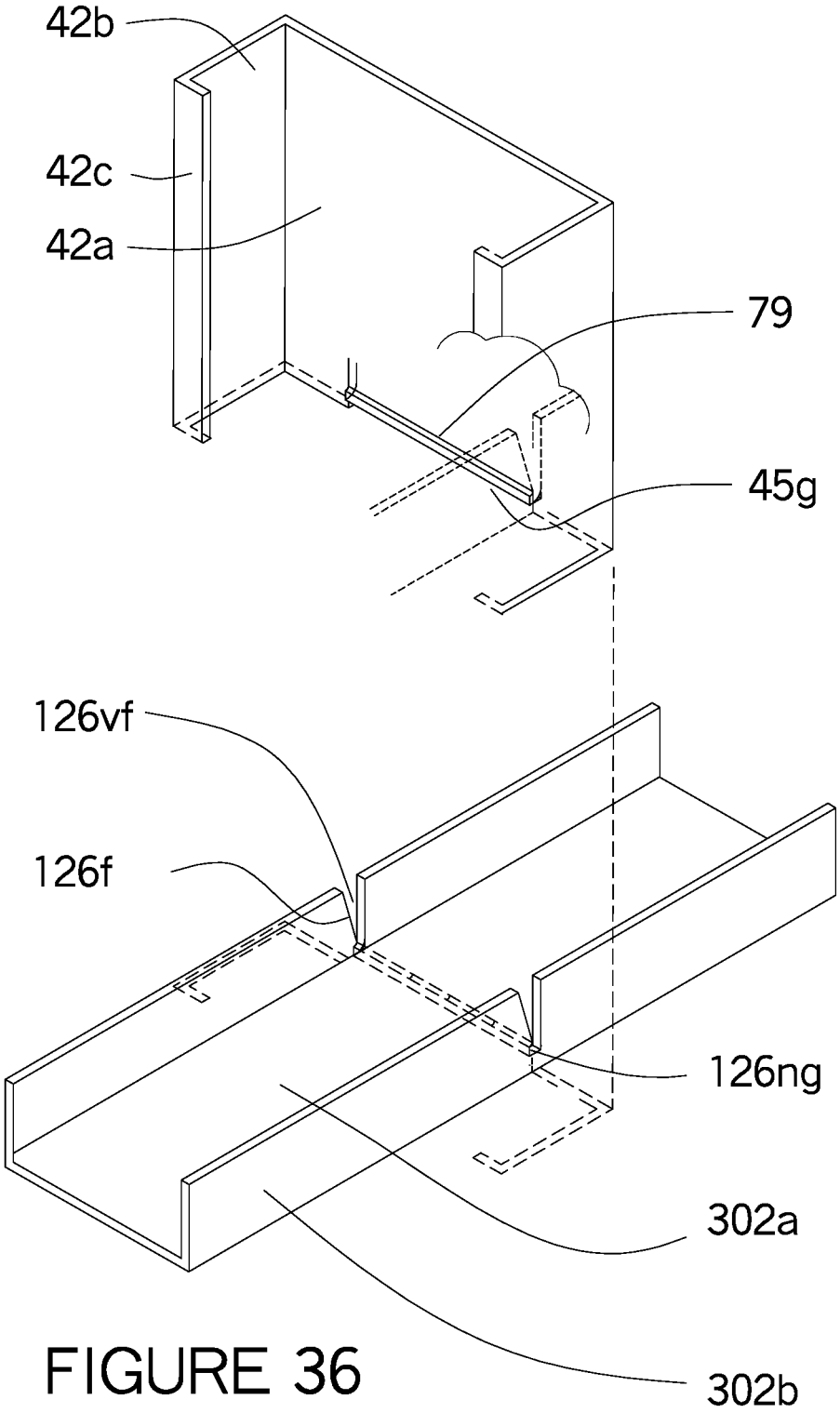
FIG. 36 shows and enlargement of the ledge being inserted into the notch gap of the flanges.

FIG. 35 is similar to FIG. 1 highlighted as Cloud D. The bottom edge of the support member shows the ledge 79 the full width of the U shaped spacer brace 302 and shown in the enlargement in FIG. 36. The U shaped spacer brace 302 is shown with the dorsal side facing downward against a floor and its flanges 302*b* extend ventrally upward from the web 302*a*. The flanges 302*b* have vertical-flange notches 126*vf* on both flanges 302*b* with one side edge having a flared edge 126*f* with a notched gap 126*ng* for the ledge 79 to fit into. The ledge 79 is shown at the bottom edge of the web 42*a* of the support member. In FIG. 36 the underside of the ledge 79 is supported at the anchor space 355 on the web 302*a* of the U shaped spacer brace 302 leaving a ledge gap 45*g* between the underside of the ledge 79 and the bottom edge of the support member. As stated earlier the ledge 79 can be short, the depth of the treaded screw or greater depending on the pressure exerted on the ledge 79. If the ledge 79 is too long, then the ledge 79 would have to be longer than the support member in order for the ledge 79 to bear directly onto the 42*a* of the C channel 42.

Figure 37:
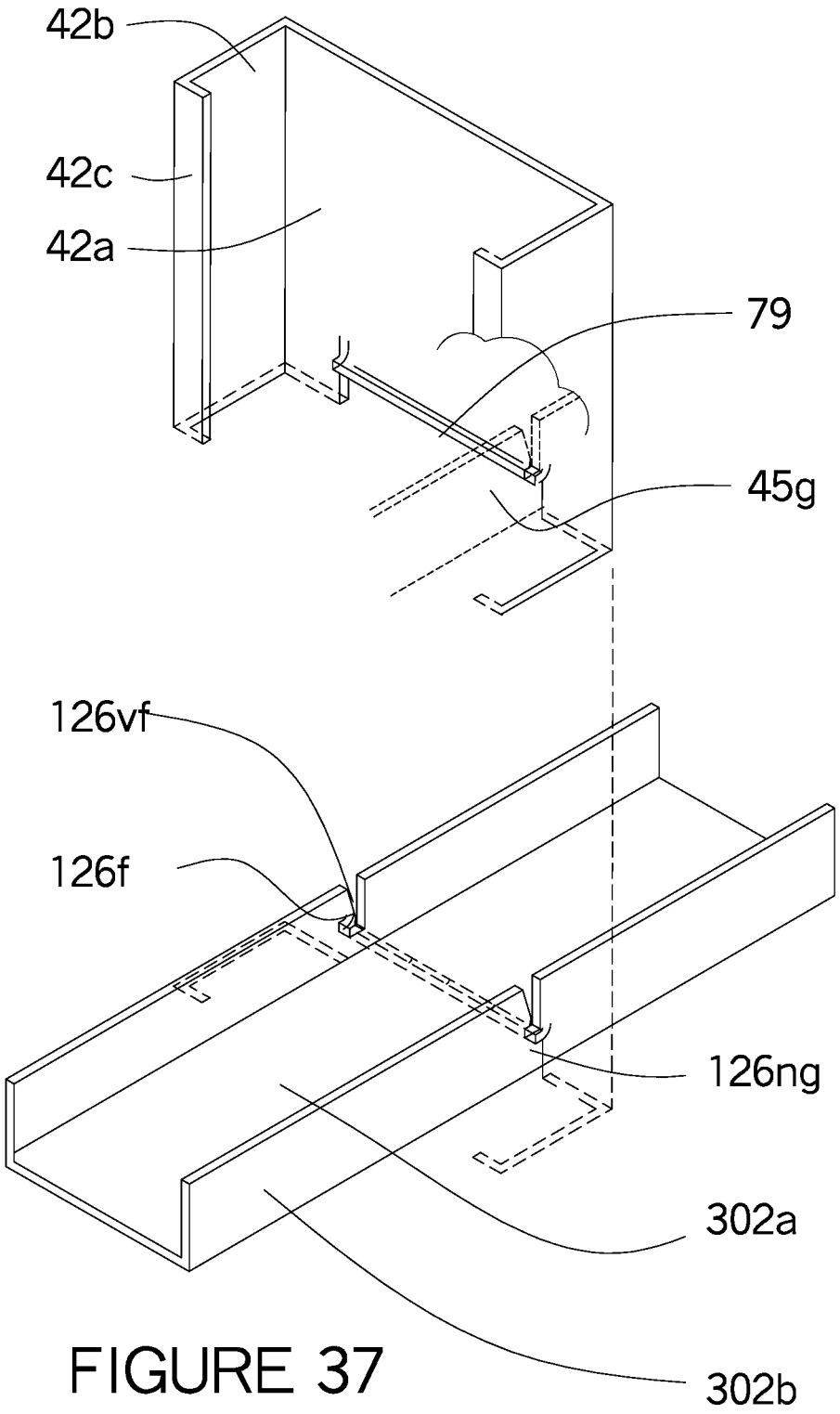
FIG. 37 is similar to FIG. 36 however the gap is inserted into the flanges only half way into the depth of the flanges.

FIG. 37 is similar to FIG. 36, however the vertical-flange notch 126*vf* extends only partially into the flange 302*b* leaving a larger ledge gap 45*g* than in FIG. 36. The ledge 79 is elevated above the web 302*a* so the ledge 79 only has the two side flanges 302*b* at the notch gap 126*ng* to rest onto. The ledge 79 shown in FIG. 34 shows an indentation 79*i* in the web 42*a* so the web 42*a* of the support member at the ledge indentations 79*i* could rest onto the vertical-flange notches 126*vf*. An additional ledge 79 would have to be installed at the ledge indentation 79*i* in order for the ledge 79 to be installed into the notch gap 126*ng*.

Figure 38:
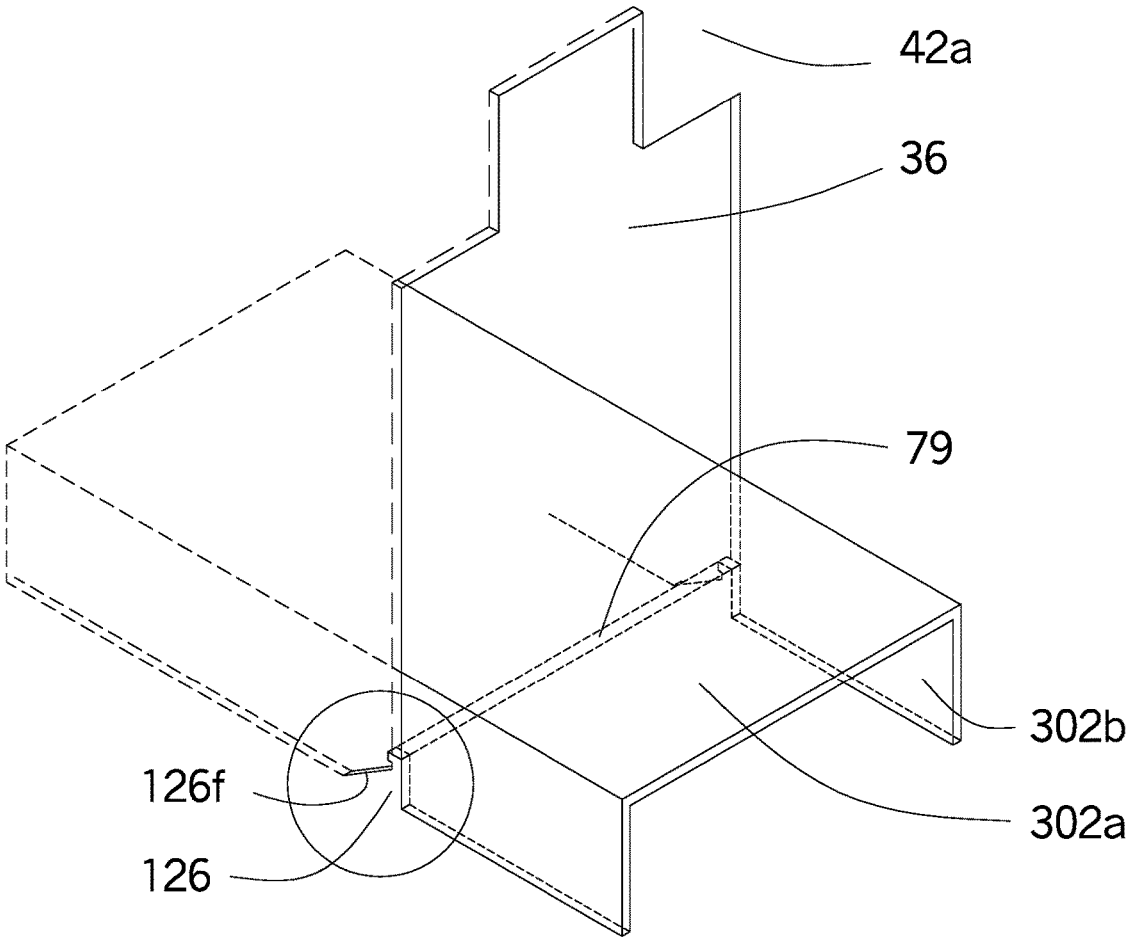
FIG. 38 shows an isometric view of the U shaped spacer brace passing through the hole of the support member having the bottom edge as a ledge engaging the U shaped spacer brace at the notch gap in the flanges.
Figure 39:
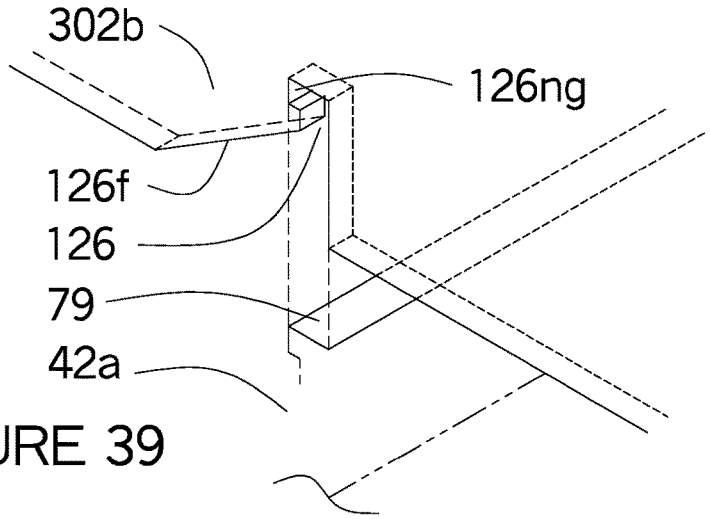
FIG. 39 is an isometric view of an enlargement of FIG. 38 where the notch and notch gap are shown in the flange of the U shaped spacer brace having the dorsal side facing upward with the flanges extending downward from the web.

FIG. 38 also shows the shows the U shaped spacer brace 302 fitting into the hole 36 having the dorsal side facing upward with the flanges 302*b* extending ventrally downward and where the flanges 302*b* have vertical-flange notches 126*vf* at the midway up into the flanges 302*b*. The hole 36 has a ledge 79 on the bottom edge and the flanges 302*b* have a notch gap 126*ng* at the end of the vertical-flange notch 126*vf* for the ledge 79 to fit into as also shown in the enlarged FIG. 39. The vertical-flange notches 126*vf* on both flanges 302*b* also have a flare edge 126*f* so the U shaped spacer brace 302 can easily slid into the vertical-flange notches 126*vf*.

Figure 40:
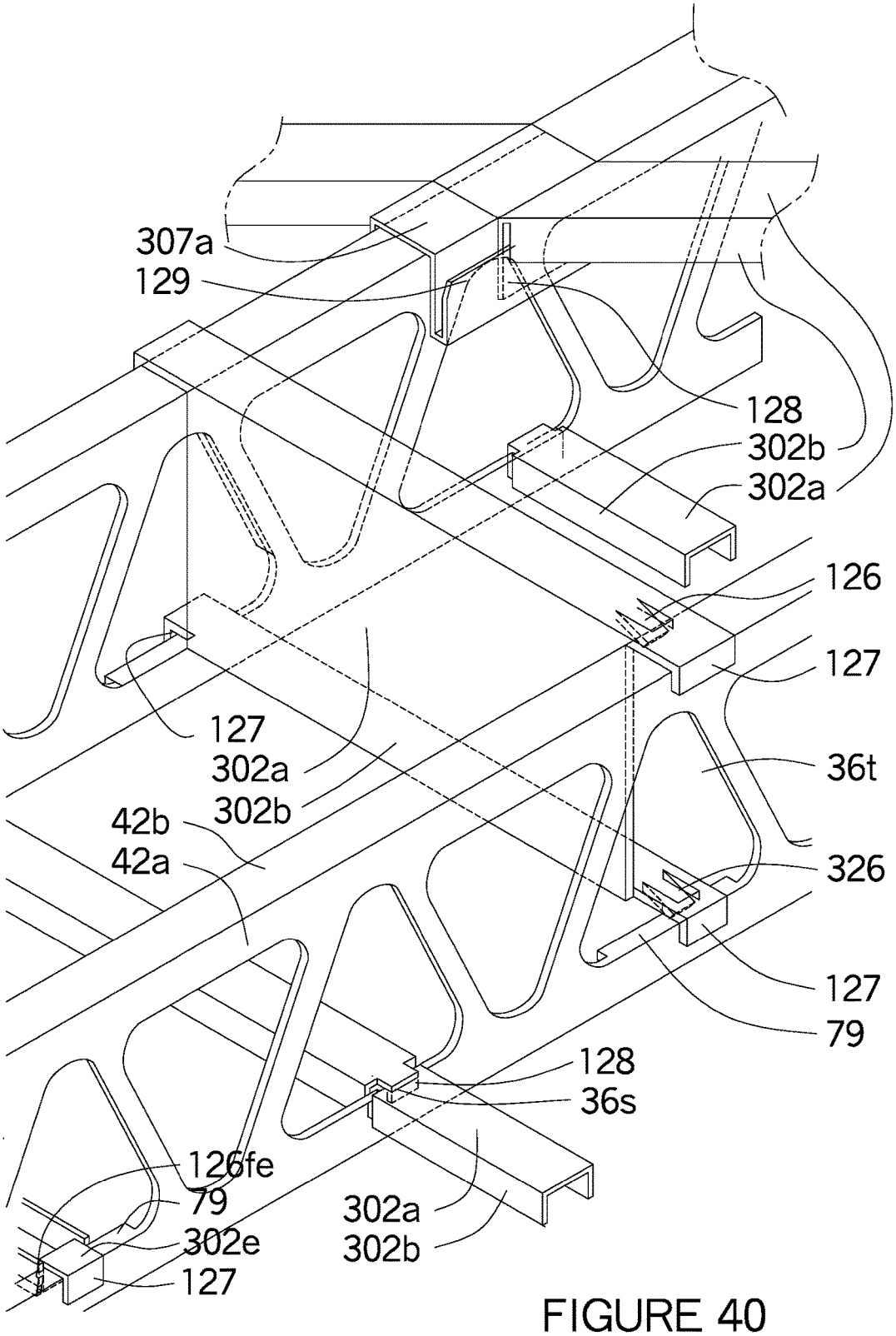
FIG. 40 shows an isometric view of a U shaped spacer brace with the receiver end having a receiver of three legs pass over a ledge and the flanges with the notch and notch gap forming another receiver end for the ledge to be inserted into.

FIG. 40 is the same isometric as FIG. 1 except another shows a U shaped spacer brace 302 is shown at the bottom left corner. The U shaped spacer brace 302 shows the web extension 302*we* passing over the ledge 79 at the bottom edge of the triangular shape hole 36*t* with the hook finger 127 extending over the web 42*a* of the support members shown as horizontal floor joists. Again the flanges 302*b* with the flange-edge notch 126*fe* are engaging the edge of the ledge 79.

Figure 41:
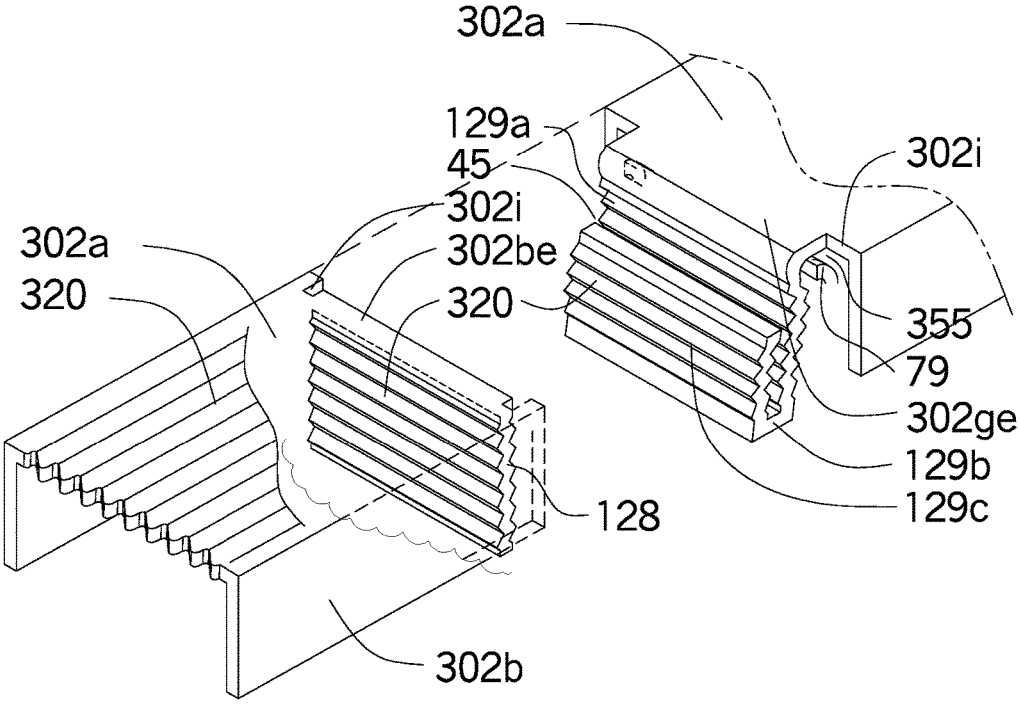
FIG. 41 shows an array of floor joists except a spacer brace at the bottom left corner shows the ledge of the floor joist intersect the notch gap of the spacer brace.

FIG. 41 shows a U shaped spacer brace 302 having the dorsal side facing upward with the flanges 302*b* extending ventrally downward. The U shaped spacer brace 302 is shown broken where the hook tongue 128 is shown having horizontally oriented ridges 320 on the left with the flanges 302*b* extending beyond the hook tongue 128 where the edges of the flanges 302*b* would engage the web 42*a* (not shown). The right U shaped spacer brace 302 has the hook receiver 129 extending from the web 302*a*. The hook receiver 129 is shown with the first leg 129*a* extending downward from the web 302*a* then horizontally at the second leg 129*b* and third leg 129*c* extending vertically upward leaving a gap 45 between the first and third legs 129*a* & 129*c*. The hook tongue 128 fits into the gap 45. The hook tongue 128 and the first and third legs 129*a* & 129*c* all have horizontal ridges 320 so the ridges 320 can interlock between each other forming a self-locking connection between each other. FIG. 41 shows the ledge 79 on the ventral side of the U shaped spacer brace 302 under the ledge extension 302*ge* protruding outwardly from the web 42*a* toward the hook receiver 129. The ledge extension 302*ge* rests onto the ledge 79 and the hook receiver 129 extends over the ledge 79. Since a ledge 79 can occur at the top of a support member, not specifically at a hole 36, it is referred to as a ledge extension 302*ge*. Another self-locking connection occurs when the ledges 79 at the top, bottom or the support member or at the side edges of the holes 36, occupy the anchor space 355 at the ledge extension 302*ge* and the first leg 129*a* wraps-around the ledge 79 at the front side edge and bottom side edge then turns parallel to the web 42*a*, but extends slightly outward having a fluid shape similar to the W-shaped clip 307. The second leg 129*b* and third leg 129*c* including the flare 128*d* are shaped similar to the W-shaped clip 307. As explained earlier the side edges of the holes 36, side edges of the ledges 79 or the sides of the flanges 302*b* all restrict any horizontal movement of the U shaped spacer brace 302 at the support member. In addition the left U shaped spacer brace 302 the hook tongue 129 has a bend extension 302*be* at the web 302*a* for the hook tongue 129 to extend downward and the flanges 302*b* extend past the hook tongue 129 so the flanges 302*b* can abut the web 42*a* of the support member.

Figure 42:
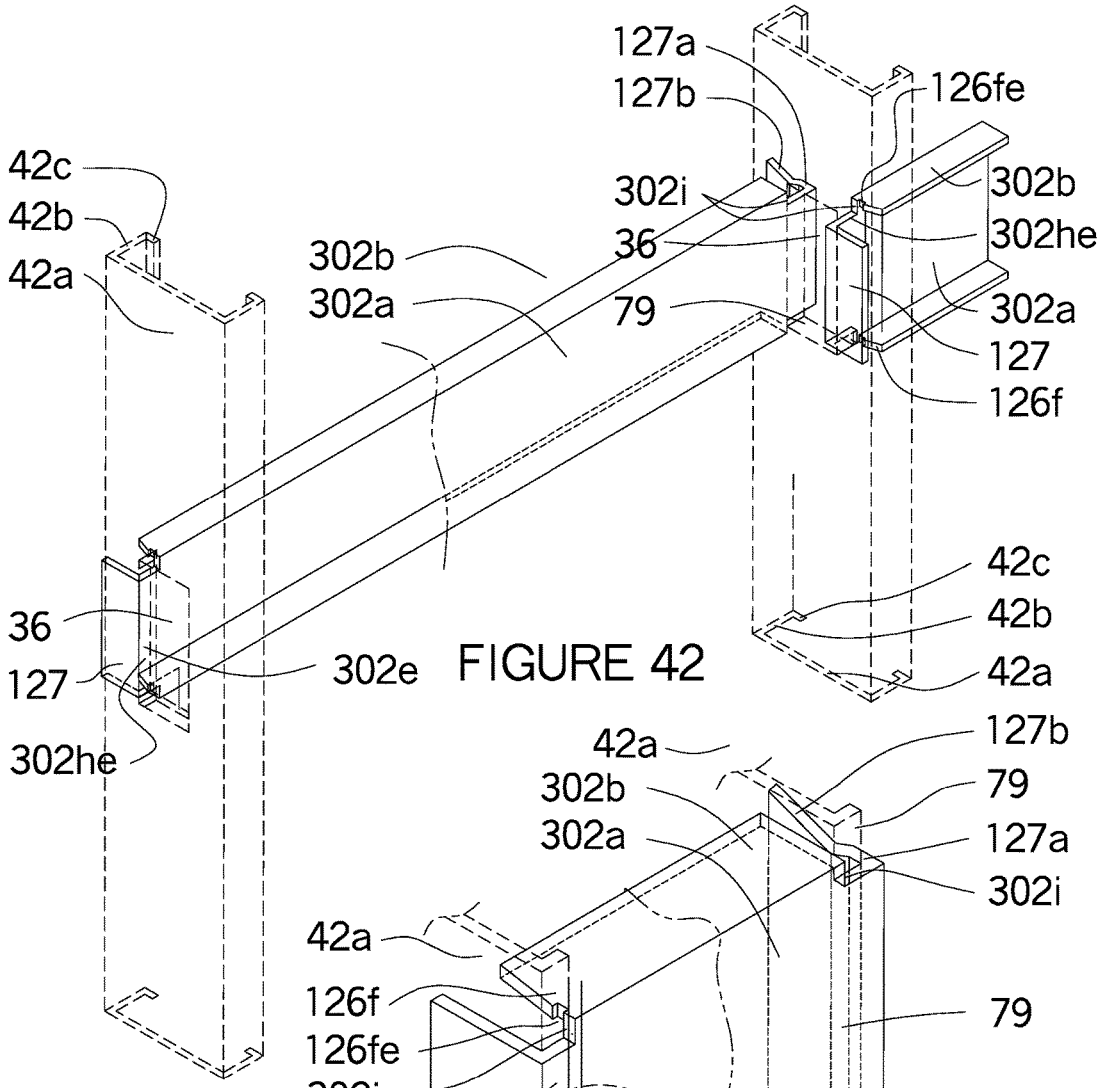
FIG. 42 shows an isometric view of a U shaped spacer brace being installed on the vertical side edges shown as a ledge at the holes in the support members and where the U shaped spacer braces on installed on both vertical side edges of the hole of a support member.
Figure 43:
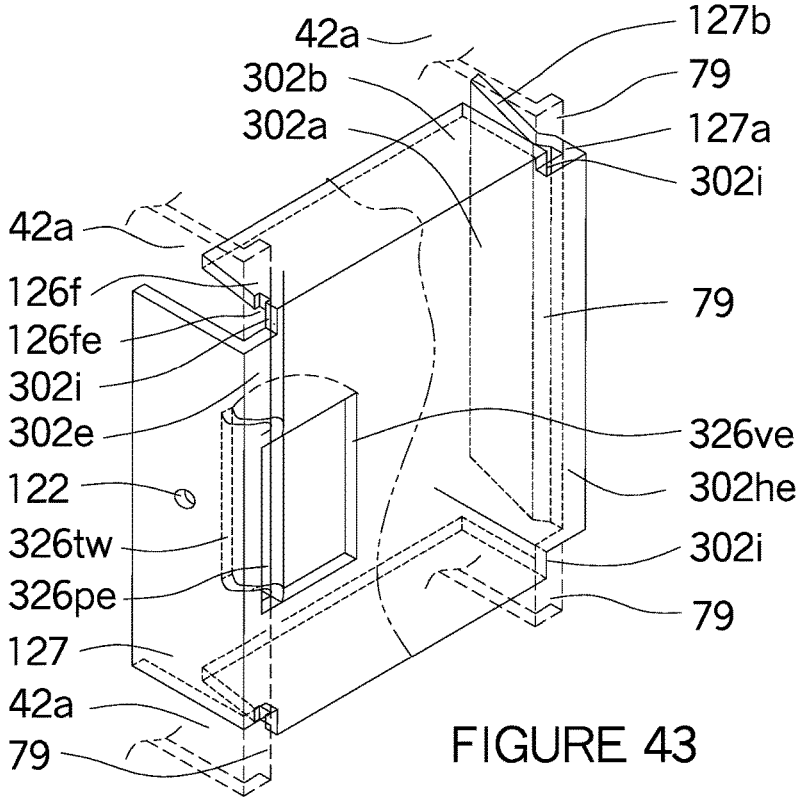
FIG. 43 is an enlargement at the intersection of the ledge in the support member and the notch gap in the flange of the spacer brace.

As discussed in FIG. 34 holes 36 can also have ledges 79 on the side edges and shown in FIG. 1 the U shaped spacer braces 302 are spanning between the side edge of the holes 36 in the support members. In FIG. 42 on the left ends of the U shaped spacer braces 302 show a hook finger 127 extending through the hole 36 where the flanges 302*b* engage the web 42*a* on one side and the hook finger 127 engaging the web 42*a* on the opposing side. The holes 36 show ledges 79 installed on the vertical side edges of the hole 36. The hook finger 127 has a hole extension 302*he* that extends over the ledges 79 and where the ledges 79 extend over the web 42*a* of the support members. The ends of the flanges 302*b* of the U shaped spacer braces 302 have flange-end notches 126*fe* for the ledge 79 to fit into. The hook finger 127 and the ledges 79 engaged into the flange-end notches 126*fe* for a self-locking connection to prevent any vertical movement of the U shaped spacer brace 302 engaging the support member. The right ends or the opposite end shows the hook finger 127 having a U-shape where the hook finger 127 extends over the ledge 79 so the first leg 127*a* wraps-around and extends over the front edge of the ledge 79 and under the ledge 79 then parallel to the web 42*a* of the support member then having an outward projecting flare at the second leg 127*b*. The hook finger 127 with its U-shape supports the support member on one side of the web 42*a* and the flanges 302*b* abut the web 42*a* on the opposite side again forming a self-locking connection between the support member and the U shaped spacer brace 302. FIG. 43 shows an enlargement of both the self-locking connections. A fastener 122 is shown on one of the fingers 127, should an engineer specify a fastener 122 over and above the self-locking connection described. In addition the left side shows a punched out tab 326 on the web 302*a* close to the vertical oriented lip 79 at the hole 36. The punched out tab 326 has a wrap-around tab 326*tw* extending from the pivot edge 326*pe* just above the ledge 79 and bent ventrally at the vented edge 326*ve* having the wrap-around tab 326*tw* extending over the front edge of the ledge 79 then under the ledge 79 toward the ventral side of the web 42*a* than veering away from the web 42*a* forming a flare at the end. The flared end of the wrap-around tab 326*tw* allows the wrap-around tab 326*tw* to bend around the ledge 79 and the bend of the wrap-around tab 326*tw* under ledge 79 secures the wrap-around tab 326*tw* from moving horizontally away from the vertically oriented ledge 79. FIG. 43 shows the hook fingers 127 on both ends of the U shaped spacer brace 302, however both sides could have the hook receivers 129 at both ends. The right end would then have the hook receiver 129 as shown in FIG. 41 where the ledge 79 protrudes outwardly from the web 42*a* toward the hook finger 127. The left end of the U shaped spacer brace 302 would then require the wrap-around tab 326*tw* from the punched out tab 326 to extend around the ledge 79. In other words, the wrap-around tab 326*tw* can be used on any type support member.

Figure 44:
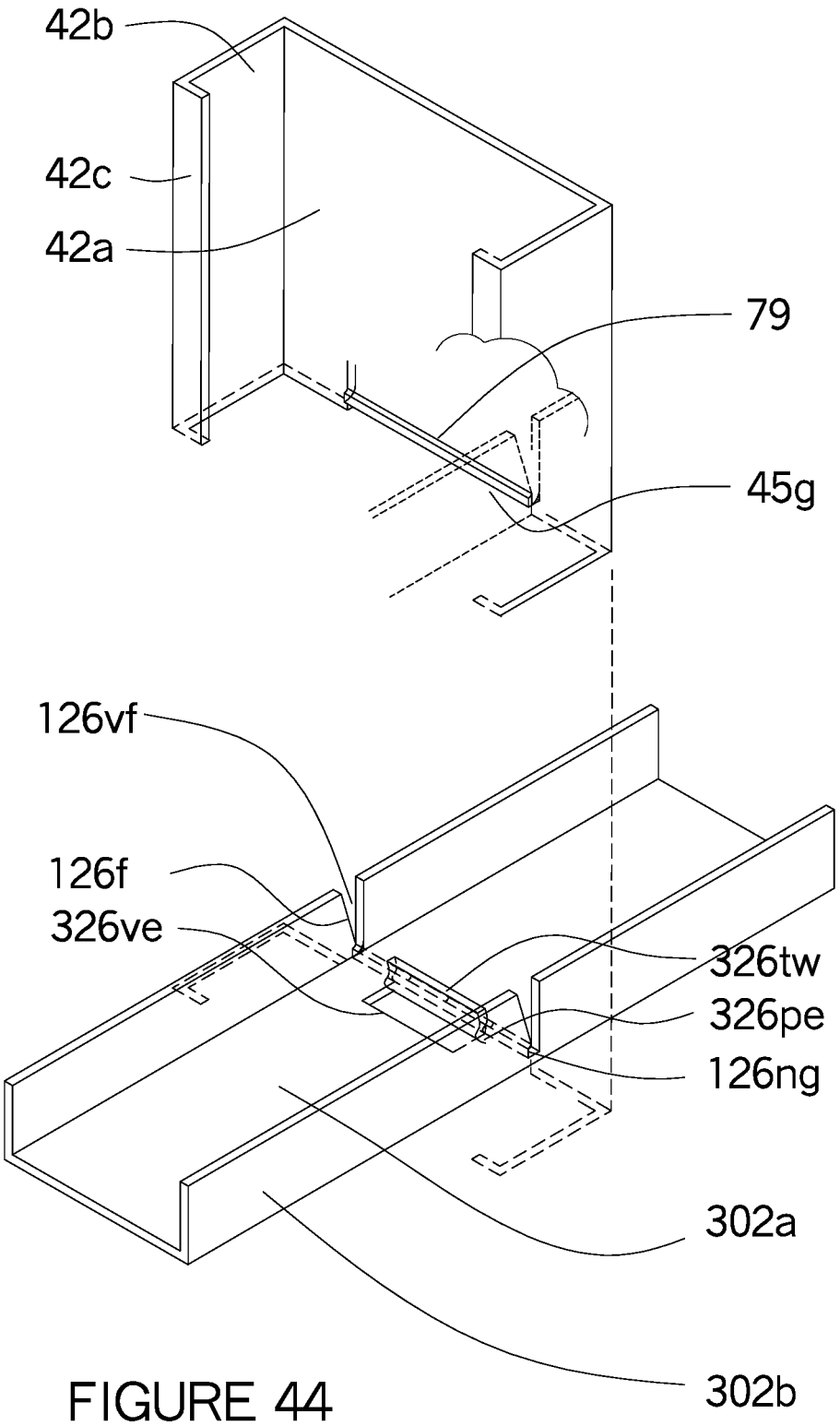
FIG. 44 shows an intermediate support member having a ledge at the bottom edge being inserted into the notch gap of the flanges and the tab from the punch out holes wraps-around the ledge at the end of the support member.

FIG. 44 is similar to FIGS. 35 & 36 where the U shaped spacer brace 302 has the dorsal side facing downward and intermediate support members intersect the U shaped spacer brace 302. The ledge 79 is shown protruding outwardly on the ventral side of the web 42*a* at the end of the support member. The length of the ledge 79 is shown the width of the U shaped spacer brace 302 and shown in FIG. 34 having a ledge gap 45*g*, however the ledge 79 can be any length in order for the web 302*a* of the U shape spacer brace 302 to fit into the flanges 302*b*. The flanges 302*b* has a vertical-flange notch 126*vf* for the web 42*a* to fit into and a notched groove 126*ng* for the ledge 79 to fit into when inserted into the U shaped spacer brace 302. The vented edge 326*ve* of the punched out tab 326 is located on the protruding side of the ledge 79 so the pivot edge 326*pe* can have the wrap-around tab 326*tw* extend over and under the protruding top, front and bottom edge of the ledge 79. The web 302*a* of one U shaped spacer brace 302 shows the web 302*a* having a wrap-around tab 326*tw* from the punched out tab 326 with the vented edge 326*ve* close to the ledge 79 so the wrap-around tab 326*tw* can be installed under the ledge 79.

Figure 45:
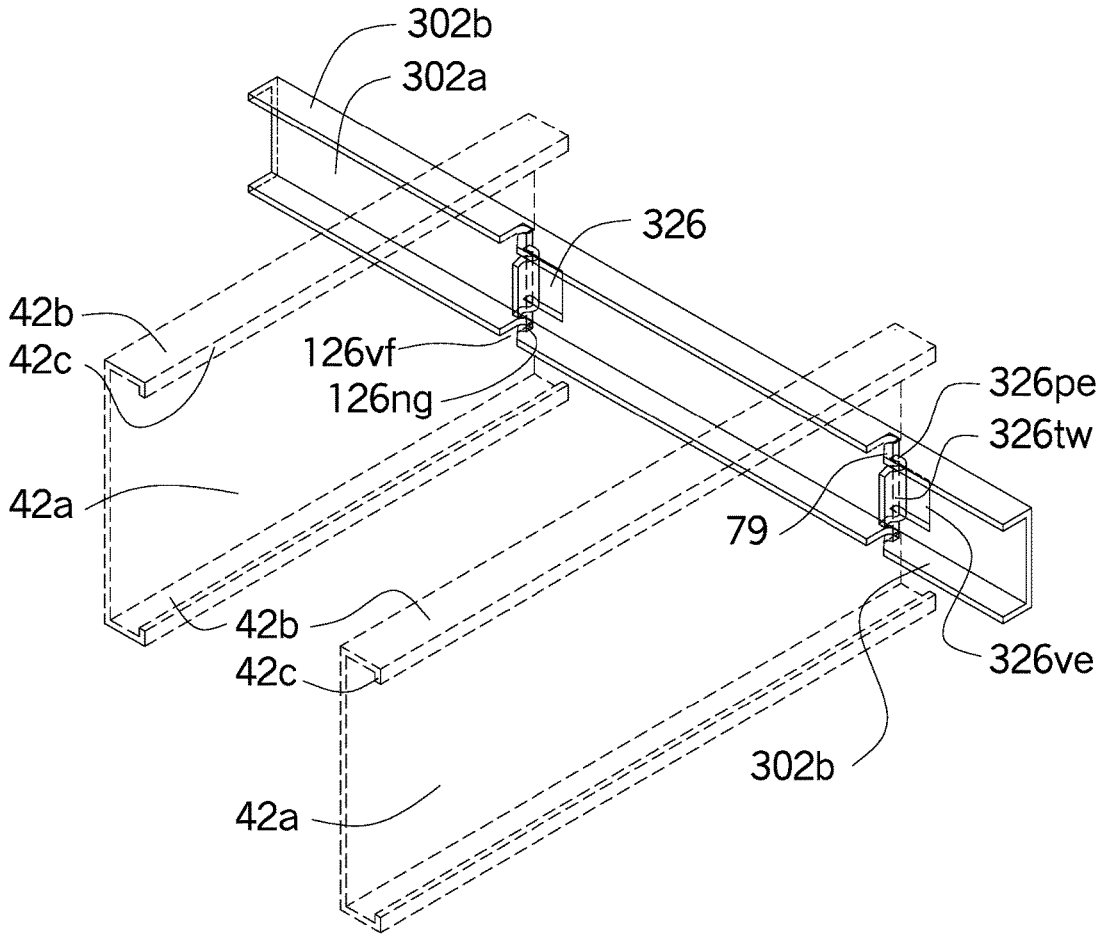
FIG. 45 shows the same profile as FIG. 209, however the support members are oriented horizontally as a floor joist and the U shaped spacer brace is oriented vertically as a ledger or sometimes referred to as a rim joist.
Figure 46:
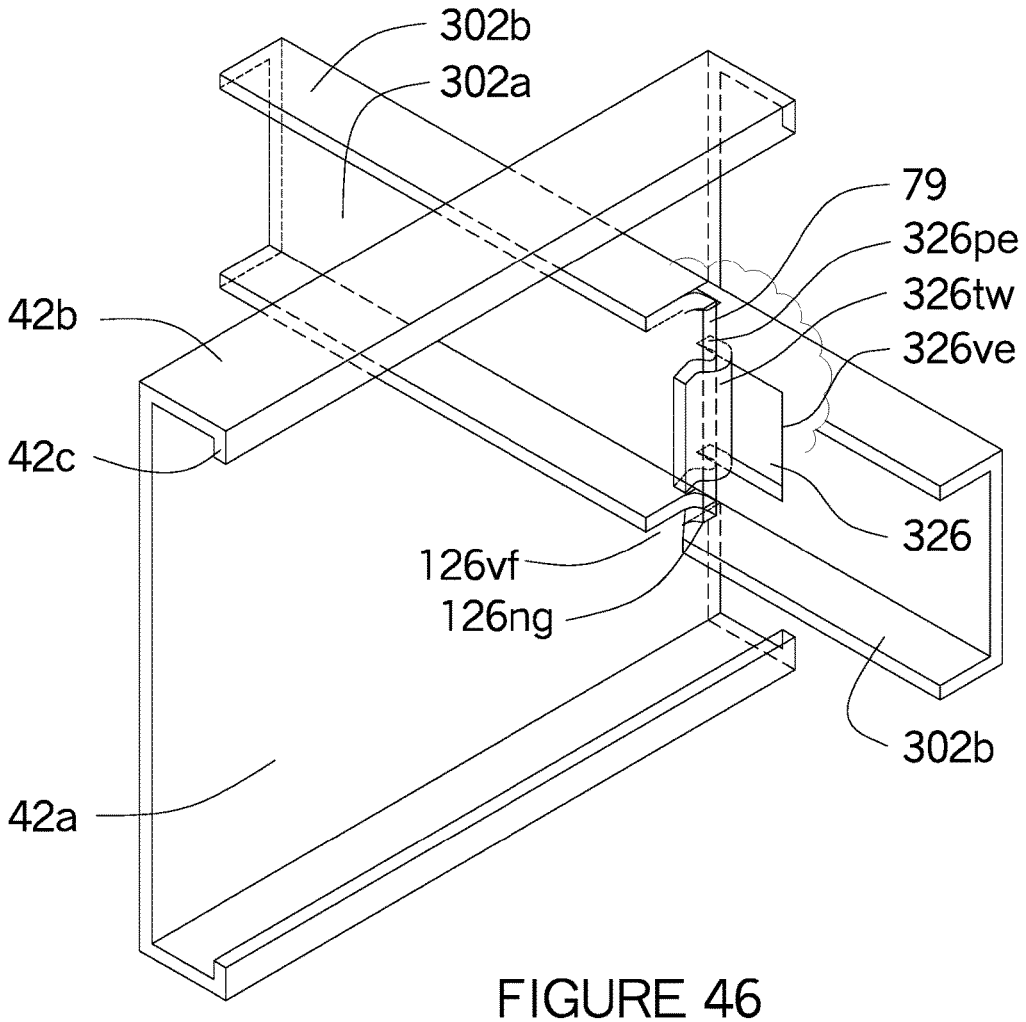
FIG. 46 is an enlargement of FIG. 45.

FIG. 45 shows an isometric of horizontal oriented floor joists also referred to as support members and are shown as C channels 42 having a vertically oriented web 42*a* with ventrally extending flanges 42*b* and lips 42*c* forming a C-shape. The ends of the support members has a ledge 79 the same width as the crossing U shaped space brace 302 so the web 302*a* with flanges 302*b* extending ventrally outward toward the C channel 42. The flanges 302*b* have a vertical-flange notch 126*vf* and a notch groove 126*ng* in the flanges 302*b* for the ledge 79 to fit into. The web 302*a* of the U shaped spacer brace 302 has a punched out tab 326 where the tab is a wrap-around tab 326*tw* that wraps around the ledge 79. Under the ledge 79 the pivot edge 326*pe* has the wrap-around tab 326*tw* extend over the front edge of the ledge 79 and wraps-around the ledge 79 securing the wrap-around tab 326*tw* to the U shaped spacer brace 302. The end of the wrap-around tab 326*tw* has a slight flare the extends outward from the web 42*a* making the ledge 79 fit between the wrap-around tab 326*tw* and the vertical-flange notches 126*vf* at the flanges 302*b*. FIG. 45 shows the support member using dashed lines for clarity purposes and FIG. 46 is an enlargement of FIG. 45. The U shaped spacer brace 302 can be the same height as the support member and therefore the additional punched out tabs 326 can be installed in the web 302*a*. When the U shaped spacer brace 302 is fully height a common term for that member is sometimes called a ledger.

Figure 47:
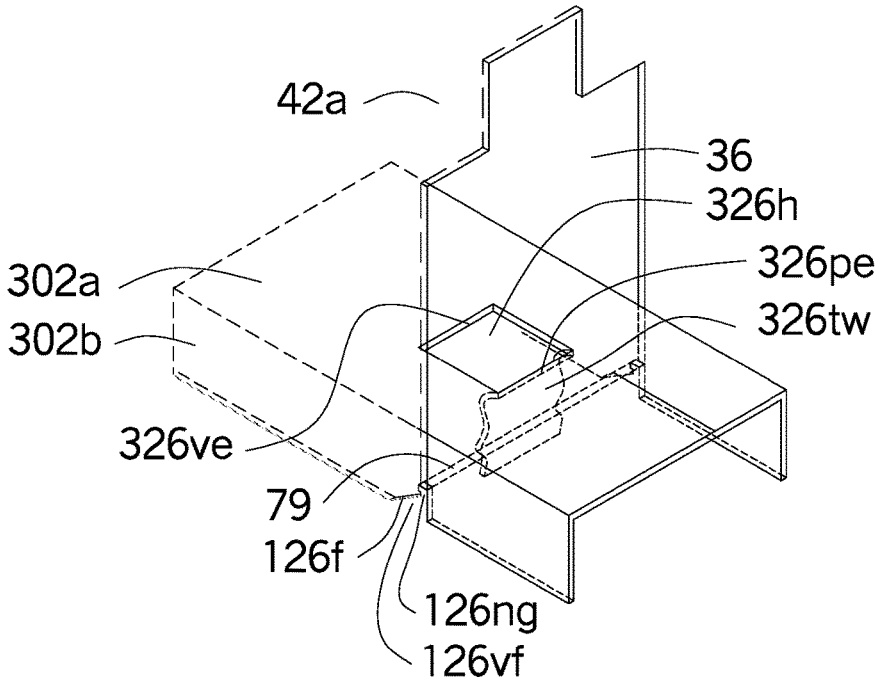
FIG. 47 shows the spacer brace facing downward passing through the hole of an intermediate support member with the flanges engaging the a ledge at mid-height together with the wrap-around tab from the punched out tab self-locking into the ledge.

FIG. 47 shows an intermediate support member intersecting the U shaped spacer brace 302 at the hole 36 which is the same width of the hole 36. The U shaped spacer brace 302 has the dorsal side facing upward with the flanges 302*b* extending ventrally downward onto the ledge 79 shown at the bottom edge of the hole 36. The flanges 302*b* have a vertical-flange notch 126*vf* only extending partway into the flanges 302*b* with a flared edge 126*f* on one side and a notch groove 126*ng* at the end of the vertical-flange notch 126*vf*. A punched hole tab 326 is shown on the web 302*a* extending ventrally downward where the wrap-around tab 326*tw* is aligned with the edges of the punched out tab hole 326*h* and the vented edge 326*ve* extends outward in the same direction as the overhanging ledge 79 with the wrap-around tab 326*tw* extends downward over the ledge 79 and then bent under the ledge 79 and then again away from the web 42*a* forming a flare. The outward projecting flare of the wrap-around tab 326*tw* allows the wrap-around tab 326*tw* to more easily pass around the ledge 79 allowing a portion of the wrap-around tab 326*tw* to be secured to the ledge 79. The depth of the vertical-flange notch 126*vf* does not penetrate the full depth of the flanges 302*b* as shown in both FIGS. 47 & 48.

Figure 48:
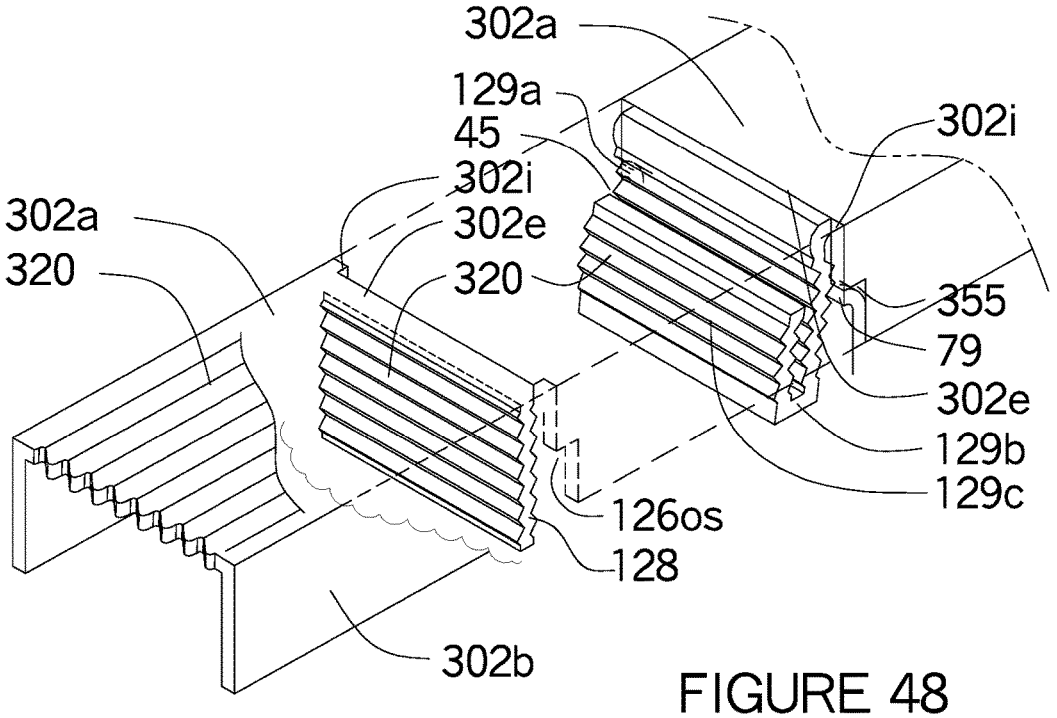
FIG. 48 shows the end of a downward facing spacer brace passing through the hole of a support member where the flanges engage the ledge at mid-height having a notch on the flange to rest on and the receiver end passing over around and under the ledge so the first leg of the receiver can extend outward again in front of the ledge before bending again to form the second leg.

FIG. 48 shows the end of a U shaped spacer brace 302 having a hook tongue 128 extending downward from the web 302*a* at the left U shaped spacer brace 302 with the ends of the flanges 302*b* abutting the web 42*a* of the support member. The U shaped spacer braces 302 on the left and right side of the support member have their ventral sides facing downward with the flanges 302*b* extending from the webs 302*a*. The right U shaped spacer brace 302 has the flanges 302*b* having off-set notches 126*os* midway up the flanges 302*b* where lower portion rests against the web 42*a* and the off-set notches 126*os* rest on the top of the ledge 79 at the anchor space 355 and the hook receiver 129 has the first leg 129*a* extend downward past the front edge of the ledge 79 then indented inward under the bottom side of the ledge 79 then again away from the web 42*a* before the second leg 129*b* extends perpendicular then the third leg 129*c* is bent upward having a gap 45 between the first and third legs 129*a* & 129*c* then extend slightly outward away from the first leg 129*a* allowing then the hook tongue 128 to be inserted into the hook receiver 129. Both the hook tongue 128 and hook receiver 129 have ridge 320 that form an abrasive means to secure the hook tongue 128 and hook receiver 129 together. The self-locking connection of the flanges 302*b* pinned between the first leg 129*a* of the hook receiver 129 and the notch 126 and the first leg 129*a* of the hook receiver 129 having an in-out undulation in the first leg 129*a* is the opposing direction abrasive means. The undulation of the first leg 129*a* is probably equal to the thread of many screws to obtain the same abrasive means between the two surfaces.

Figure 49:
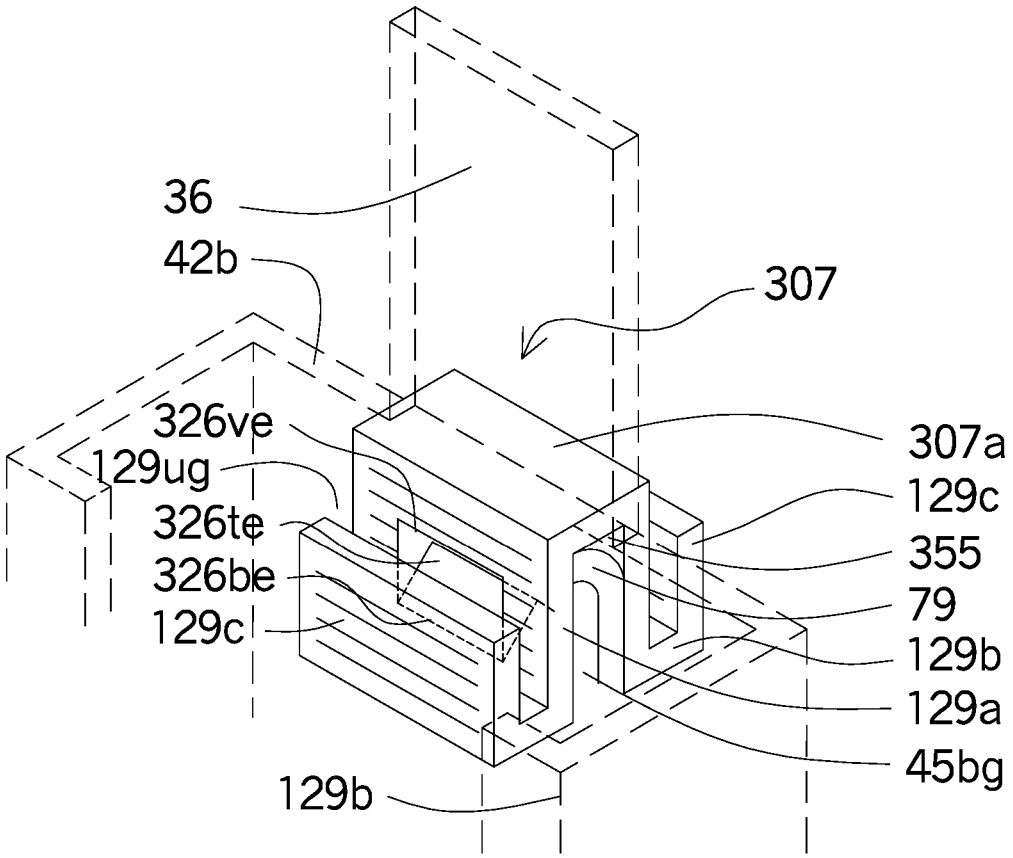
FIG. 49 is similar to FIG. 3, however only one punched out tab is shown and used as a support under the ledge.

FIG. 49 shows the same W-shaped clip 307 as shown in an earlier provisional patent application, except here only one punched out tab 326*t* is shown and the first and third legs 129*a* & 129*c* or the hook receiver 129 are shown having horizontally oriented ridges 320 that would give an abrasive resistance to the hook tongue 128 which would also have the ridges 320. I am just trying to claim a ledge can penetrate the first leg of a hook receiver.

Figure 50:
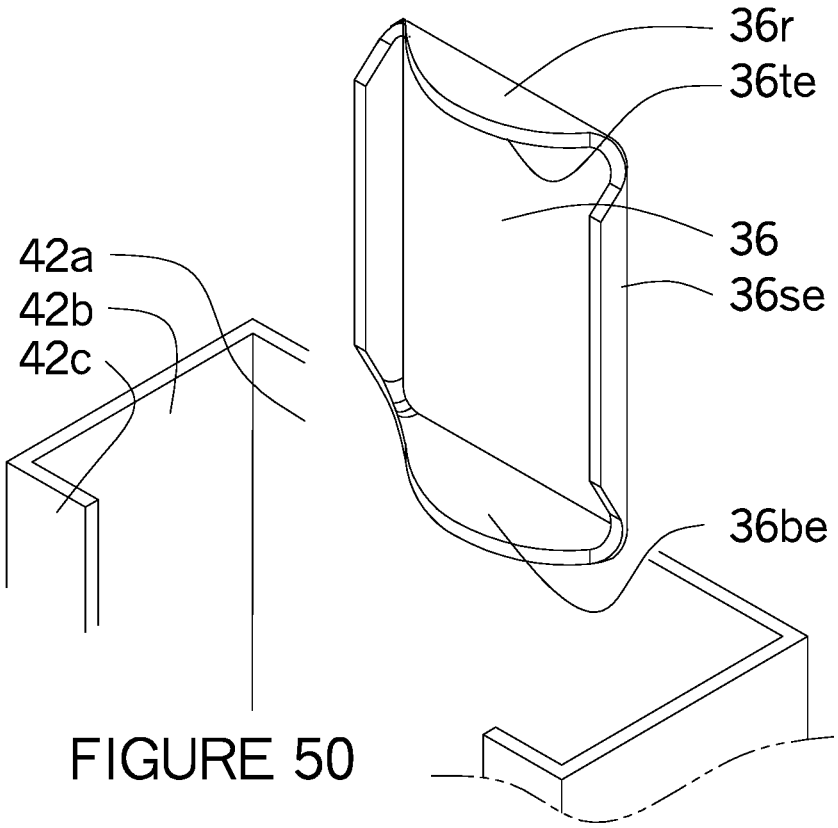
FIG. 50 an irregular shape hole have a continuous rim extending around the hole edges leaving a narrow edge in the corner where the W-Clip could be inserted into the rim of the hole if the rim had a notch or the W-clip was bent to create a notch to form a secure connection.
Figure 51:
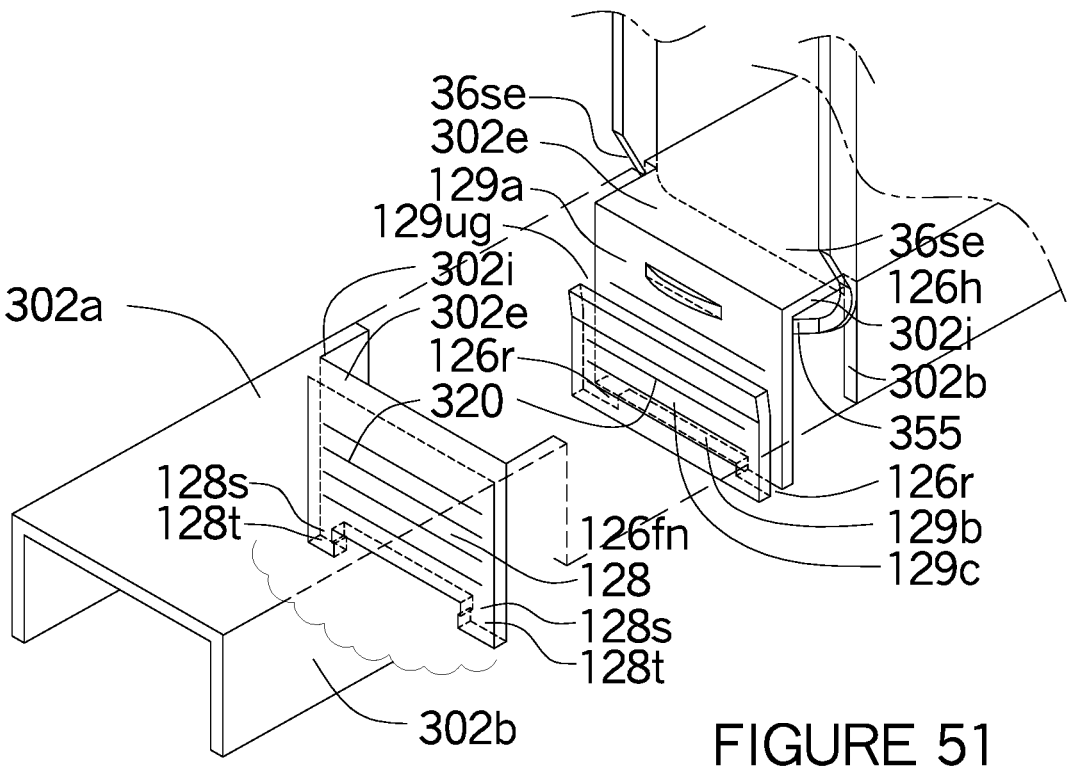
FIG. 51 shows a U shaped spacer brace extending through the hole in FIG. 50 where the bottom edge of the rim penetrates the first leg of the hook receiver.

FIG. 50 shows a hole rim 36*r* having a rectilinear shape with a continuous shaped hole rim 36*r* extend from the web 42*a* of the support member and where the corners have a short depth at the hole rims 36*r*. FIG. 51 shows a U shaped spacer brace 302 extending through a hole 36 shown similar to the U shaped spacer brace 302 in FIG. 234, however the hole bottom edge 36*be* in FIG. 50 has an irregular shape configuration. The hook receiver 129 is shown extending over the irregular shape of the hole bottom edge 36*be* due to the shape of the hole rim 36*r*. The first leg 129*a* of the hook receiver 129 shows a receiver slot hole 36*rs* so the hole rim 36*r* can fit into. If the hook receiver 129 extends through the hole 36 in reverse, the flanges 302*b* would have notches 126 at the end side edges of the flanges 302*b* for the hole rim 36*r* could fit into will the hook receiver 129 would have extended over the hole bottom edge 36*be* against the web 42*a*. The hole rim 36*r* are very irregular so notches could be installed in the hole rim 36*r* to accomplish a similar self-locking connection.

The present invention presents a unique self-locking metal framing connection system that is so versatile that spacer braces and vertical support members can be installed easier and quicker than other metal framing systems. It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

FIGURE NUMBER GLOSSARY OF TABLE OF CONTENTS

36 36*fs*-flange-slot hole
42 C channel 42*a*-web, 42*b*-flange, 42*c*-lip
45 gap, 45*g*-ledge gap, 45*bg*-back leg gap
76 flap
79 ledge: 79*i*-ledge indentation,
122 fasteners
126 notches: 126*f*-flare edge, 126*ng*-notch gap, 126*vf*-vertical-flange notch, 126*fe*-flange-edge notch, 126*os*-off-set notch
127 hook finger:
128 hook tongue
129 hook receiver: 129*a*-first leg, 129*b*-second leg, 129*c*-third leg, 129*ug*-U-gap receiver
131 punched out hooks
302 U shaped spacer brace: 302*a* web, 302*b* flange, 302*we*-web extension, 302*he*-hole extension, 302*e*-extension (general), 302*ge*-ledge extension, 302*be*-bend extension
305 I shaped spacer brace
307 W-shaped clip: 307*a*-web
308 U-shaped clip: 308*a*-web
309 hold-down spacer brace: 309*a*-web, 309*b*-flange, 309*e*-extension, 309*i*-indentation, 309*we*-web extension
320 ridges
326 punched out tabs: 326*ve*-vented edge, 326*se*-side edge, 326*pe*-pivot edge, 326*t*-tab, 326*et*-extended tab, 326*tw*-wrap-around tab, 326*ta*-tab A, 326*th*-tab B
355 anchor space

CLAIMS GLOSSARY TO TERMS

The spacer brace typically being defined as a U shaped spacer brace 302 having a hook receiver 129 at one end and a hook tongue 128 on the opposing end where the spacer brace engages the support member at the top edge, bottom edge or in the hole 36 of a support member. Different spacer brace configurations may occur where the opposing ends of the U shaped spacer brace can each have hook receivers 129 or each end having hook tongues 128 or each end having hook fingers 127. When describing the width profile of spacer brace configuration can be U-shaped (two flanges and a web) and when describing the longitudinal profile the U-shape configuration has two longitudinal walls spaced with a longitudinal web spaced between the longitudinal walls with web ends being connected the (hook tongue, hook receiver or hook finger).

In the claims the female receiver has a first wall and third wall as a (hook receiver 129, hook tongue 128 or a hook finger 127) and the second wall connecting the second ends of the first and third walls. The first and third walls all have back leg gaps 45*bg* (open space) between the first and third walls for the tabs 326*t* from the punch out tabs 326 to engage the ledge 79 at the open space referred to as the back leg gap 45*bg*. The hook receiver 129 has a U-gap receiver 129*rg* with tabs 326*t* from the punch out tabs 326 to engage the male member (hook tongue 128) also having tabs 326*t* from the punch out tabs 326*t* to engage each other.

The female receiver where the first wall (first leg 129*a*) has at least one punch out (punch out tab 326) with a tab 326*t* extending out the back side into the back leg gaps 46*bg* (to engage ledges 79 extending from the metal framing and the second wall web 302*a*, 307*a*, 308*a*) having a tab 326*t* extend into the back side of the second wall to engage the underside of the ledges 79.

The female receiver can be oriented so the second wall is installed over or under the ledge 79 so the tab 326*t* extends under the hole bottom edge 36*be* depending on the orientation of the female receiver whether the second wall extends over the flange 42*b* with the first and thirds walls extending over the lip and web of the support member or the second wall extends over the ledges 79 at the holes side edges 36*se* or the holes bottom or top edges 36*te* & 36*be*. The punched out tabs 326*t* can also have hooked tabs hooks 131 that wrap around the lips 42*c* or the hole side edges 36*se* of the support member as an additional stronger engagement means to the support member. The first or third wall can also have hook tabs 131 that extend around the lips 42*c* of the support members or having the hook tabs 131 extend into the hole 36 at side edges 36*se*. The female receiver is not limited to extending over the web 42*a*, flange 42*a* and lip 42*c* of a support member, but can be installed in the holes between adjacent support members with tabs from the punch out tabs engaging the ledges of adjacent support members or the female receiver can have the first wall extend over one plane of the web 42*a* of a support member and the second wall extend over the opposing plane of the web 42*a* with the first leg of the first and third walls connect to the third wall.

A U-shaped longitudinal channel (U-shaped spacer brace 302) having a web (web 302*a*) and parallel side walls (flange 302*b*) having the interior side with its free edges facing upwards where the flanges 302*b* have cut outs (vertical-flange notches 126*vf*) adapted to receive the end of a wall (the support member or web 42*a* from the C channel 42) of a second element for metal framing.

The U-shaped support element (U-shaped spacer brace 302) the web 302*a* has a finger (a punch out 326 with tabs 326*t*) extending from the web 302*a* and adapted (having a ledge 79) to engage the second element (C channel 42 with the web 42*a*), the front side of the finger (tab 326 from the punch out tab 326) but not engaging the pair of cut outs (vertical-flange notches 126*vf*)

The U-shaped receiving end of a hooked receiver 129, the spacer brace 302 is braced against on one side of the support member with the web 42*a* extending through the opening of a support member with the inside plane of the first leg 129*a* of the hook receiver 129 is closest to the opposing side of the support member.

When analyzing some of the inventive solutions that has been described in this application is the elimination of fasteners when connecting spacer braces and support members together. The tabs from the punch out tabs interlock the spacer braces together with the support member eliminating the need to install fasteners. The ledges at the top, bottom or at the holes allows the tabs from the punch out tabs to eliminate the vertical movement between the metal framing elements. The female receivers give the means to installed punch out tabs or hook tabs to eliminate the movement between framing members.

The ledges in the support members allow the spacer brace to have notches in the flanges establishing another alternative to connected crossing framing members together without having to use fasteners.

The ledges at the side edges of the hole allow one end of the spacer brace to be inserted into the end flange notches while the opposing end is secured by having the third wall wrapping around ledge from an adjacent support member.

The invention claimed is:

1. A receiver support element used in connecting metal framing components, said receiver support element comprising:

a substantially planar web having a first edge and a second edge opposite said first edge, said planar web defining a plane;

a first flange and a second flange defining web flanges, said second flange being substantially parallel to said first flange, said first flange extending from said first edge in a direction substantially normal to said plane and said second flange extending from said second edge in a direction substantially normal to said plane, said first flange having a first end distal with respect to said web and said second flange having a first end distal with respect to said web; a third flange and a fourth flange being receiver flanges, said fourth flange being substantially parallel to said third flange and to said first flange and to said second flange, said third flange being attached to said first end of said first flange and said fourth flange being attached to said first end of said second flange, said third flange and said fourth flange extending in a direction of said plane and terminating in a respective first distal end and a second distal end, said third flange and said fourth flange each having a portion proximate said respective first distal end of said third flange and said second distal end of said fourth flange extending away from said respective first flange and said second flange;

said first flange and said second flange defining a web flange gap, said first flange and said third flange defining a first receiver gap, said second flange and said fourth flange defining a second receiver gap; said third flange and said fourth flange each having at least one resilient tab, said resilient tab of said third flange extending toward said first end of said first flange and having a distal end terminating within said first receiver gap, and said resilient tab of said fourth flange extending toward said first end of said second flange and having a distal end terminating within said second receiver gap.

2. The receiver support element according to claim 1, wherein the web is anchored on a bottom edge of a support member, wherein the web flanges are substantially parallel to the support member with said first flange having a first resilient tab and said second flange having a second resilient tab, said first tab of said first flange and said second tab of said second flange each having a distal end extending towards the planar web and terminating within said first gap against the support member.

3. The receiver support element according to claim 2, wherein the first flange has a third resilient tab and the second web flange has a fourth resilient tab, said third resilient tab extending toward said second flange and said fourth resilient tab extending toward said first flange.

4. The receiver support element according to claim 1 wherein the web extends over a bottom edge of a hole, said edge defining a ledge, said first flange and said second flange each having a resilient tab extending into and terminating within said web flange gap, a respective distal end of each of said resilient tabs extending under the ledge.

* * * * *